US011910834B2

(12) United States Patent
Liu et al.

(10) Patent No.: US 11,910,834 B2
(45) Date of Patent: Feb. 27, 2024

(54) ELECTRONIC CIGARETTE ATOMIZATION CORE AND ATOMIZER

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Xinqiang Yin, Hunan (CN); Jianhua Yi, Hunan (CN); Yongquan Zhou, Hunan (CN); Lizhou Shen, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 619 days.

(21) Appl. No.: 17/254,747

(22) PCT Filed: Jun. 19, 2019

(86) PCT No.: PCT/CN2019/091877
§ 371 (c)(1),
(2) Date: Dec. 21, 2020

(87) PCT Pub. No.: WO2019/242636
PCT Pub. Date: Dec. 26, 2019

(65) Prior Publication Data

US 2021/0267278 A1 Sep. 2, 2021

(30) Foreign Application Priority Data

Jun. 22, 2018 (CN) ..... 20180650353.4

(51) Int. Cl.
*A24F 40/485* (2020.01)
*A24F 40/10* (2020.01)
(Continued)

(52) U.S. Cl.
CPC ..... *A24F 40/485* (2020.01); *A24F 7/02* (2013.01); *A24F 40/10* (2020.01); *A24F 40/42* (2020.01); *A24F 40/44* (2020.01)

(58) Field of Classification Search
CPC ..... A24F 40/485; A24F 7/02; A24F 40/10; A24F 40/42; A24F 40/44; A24F 40/05; A24F 40/48
See application file for complete search history.

(56) References Cited

U.S. PATENT DOCUMENTS 10,426,196 B2 10/2019 Calfee et al.
2022/0361577 A1* 11/2022 Liu ..... A24F 40/485

FOREIGN PATENT DOCUMENTS

CN 205848694 U 1/2017
CN 206227716 U 6/2017
(Continued)

OTHER PUBLICATIONS

International Search Report issued in International Application No. PCT/CN2019/091877 dated Sep. 27, 2019, 2 pages.

*Primary Examiner* — Travis S Chambers
(74) *Attorney, Agent, or Firm* — Mauriel Kapouytian Woods LLP; Ran Pang; Michael Mauriel

(57) ABSTRACT

An electronic cigarette atomization core and atomizer is disclosed. The electronic cigarette atomization core includes an atomization member (3), an outer sleeve (24), a connection sleeve (22), and atomization cotton (14). A lower segment of the connection sleeve (22) is sleeved outside an upper segment of the outer sleeve (24). The outer sleeve (24) is sleeved outside the atomization cotton (14). The outer sleeve (24) is provided with a first e-liquid passage hole (2401) capable of communicating an inner cavity of an electronic cigarette e-liquid bin (12) with the atomization cotton (14). The connection sleeve (22) is axially movable or circumferentially rotatable relative to the outer sleeve (24) to
(Continued)

close or open the first e-liquid passage hole (2401). A buffer sealing structure is arranged between the connection sleeve (22) and the outer sleeve (24).

20 Claims, 22 Drawing Sheets

(51) Int. Cl.

| | |
|---|---|
| ***A24F 40/44*** | (2020.01) |
| ***A24F 40/42*** | (2020.01) |
| ***A24F 7/02*** | (2006.01) |

(56) References Cited

FOREIGN PATENT DOCUMENTS

| | | | |
|---|---|---|---|
| CN | 206687176 | U | 12/2017 |
| CN | 207011680 | U | 2/2018 |
| EP | 3 272 240 | A2 | 1/2018 |

* cited by examiner

ELECTRONIC CIGARETTE ATOMIZATION CORE AND ATOMIZER

CROSS REFERENCE TO RELATED APPLICATIONS

This application is a U.S. National Phase application under 35 U.S.C. § 371 of International Application No. PCT/CN2019/091877 filed on Jun. 19, 2019, which claims priority to Chinese Application No. 201810650353.4 filed on Jun. 22, 2018. The entire contents of these applications are hereby incorporated herein by reference.

FIELD OF THE INVENTION

The present invention particularly relates to an electronic cigarette atomization core and atomizer.

BACKGROUND OF THE INVENTION

An existing electronic cigarette atomizer is provided with a rotating e-liquid injection structure, which has the following disadvantages: an e-liquid inlet communicating an e-liquid bin with atomization cotton is generally sealed by means of relative rotation of a connection sleeve and an outer sleeve, the connection sleeve and the outer sleeve are both metal parts, and when the two metal parts are required to rotate together, the requirement for the matching dimensional precision of the two metal parts is very high, and the assembly is also very troublesome, so the production time is long, the production cost is high, the sealing effect is poor, and there are the risks of e-liquid leakage and e-liquid suction.

SUMMARY OF THE INVENTION

In the existing electronic cigarette atomizer, the e-liquid inlet is sealed by means of the relative rotation of the two metal parts, so the production time is long, the production cost is high, the sealing effect is poor, and there are the risks of e-liquid leakage and e-liquid suction. The objective of the present invention is to provide, in response to the above-mentioned shortcomings of the prior art, an electronic cigarette atomization core and atomizer, with the advantages of short production time, low production cost and good sealing effect.

In order to solve the above technical problems, the technical solution adopted by the present invention is as follows:

An electronic cigarette atomization core comprises an atomization member, an outer sleeve, a connection sleeve, and atomization cotton, a lower segment of the connection sleeve is sleeved outside an upper segment of the outer sleeve, the outer sleeve is sleeved outside the atomization cotton, and the outer sleeve is provided with a first e-liquid passage hole capable of communicating an inner cavity of an electronic cigarette e-liquid bin with the atomization cotton; wherein the connection sleeve is axially movable or circumferentially rotatable relative to the outer sleeve to close or open the first e-liquid passage hole, and a buffer sealing structure for sealing the first e-liquid passage hole when the first e-liquid passage hole is closed is arranged between the connection sleeve and the outer sleeve.

With the above structure, when an e-liquid passage needs to be cut off (for example, when e-liquid is injected and when an electronic cigarette is in a standing state for a long time), the connection sleeve is driven to move axially or rotate circumferentially relative to the outer sleeve to close or open the first e-liquid passage hole. Because the buffer sealing structure is arranged between the connection sleeve and the outer sleeve, the requirement for the matching dimensional precision of the connection sleeve and the outer sleeve is low, the assembly is convenient, the production time is short, the production cost is low, the sealing effect is good, and the risks of e-liquid leakage and e-liquid suction are avoided.

As a preferred mode, the buffer sealing structure comprises a sealing gasket fixedly sleeved outside a lower segment of the outer sleeve, and a top surface of the sealing gasket is below a lowest point of the first e-liquid passage hole or tangent to the lowest point of the first e-liquid passage hole; when the connection sleeve moves in the axial direction of the electronic cigarette until a bottom end of the connection sleeve abuts against the sealing gasket, the first e-liquid passage hole is closed; and when the connection sleeve moves in the axial direction of the electronic cigarette until the bottom end of the connection sleeve separates from the sealing gasket, the first e-liquid passage hole is opened.

When the e-liquid passage needs to be cut off (for example, when e-liquid is injected and when the electronic cigarette is in a standing state for a long time), the connection sleeve is driven to move close to the sealing gasket in the axial direction of the electronic cigarette, and the connection sleeve finally abuts on the sealing gasket, so that the first e-liquid passage hole is closed, the e-liquid passage is cut off, and the inner cavity of the e-liquid bin and the atomization cotton are in a cut-off state. When the e-liquid passage needs to be opened, the connection sleeve is driven to move away from the sealing gasket in the axial direction of the electronic cigarette, the first e-liquid passage hole is finally opened, the e-liquid passage is open, and the inner cavity of the e-liquid bin and the atomization cotton are in a communication state. Further, a bottom surface of the sealing gasket is provided with a force deformation structure.

As a preferred mode, the force deformation structure comprises a blind hole arranged on the bottom surface of the sealing gasket, with a better sealing effect.

As another preferred mode, the connection sleeve is provided with an e-liquid inlet capable of communicating the electronic cigarette e-liquid bin with the first e-liquid passage hole, and when the connection sleeve rotates circumferentially relative to the outer sleeve, the e-liquid inlet and the first e-liquid passage hole are misaligned or opposite, to close or open the first e-liquid passage hole.

Further, the buffer sealing structure comprises a sealing sleeve sleeved between the outer sleeve and the connection sleeve, the sealing sleeve is provided with a second e-liquid passage hole opposite to the first e-liquid passage hole, and the second e-liquid passage hole communicates the first e-liquid passage hole with the atomization cotton.

Further, the outer sleeve is provided with a locking hole for preventing the axial rotation of the sealing sleeve, and the sealing sleeve is provided with a boss matching the locking hole.

The locking hole matches the boss, so that the sealing sleeve is fixed reliably with the outer sleeve to prevent rotation of the sealing sleeve driven by rotation of the connection sleeve.

Further, the sealing sleeve is provided with a raised ring which faces the connection sleeve and is along the outer circumference of the second e-liquid passage hole, and the raised ring can seal the e-liquid inlet more reliably.

As a preferred mode, the atomization member comprises an ultrasonic atomization sheet.

Based on the same inventive concept, the present invention further provides an electronic cigarette atomizer, comprising the electronic cigarette atomization core. Compared with the prior art, the present invention has short production time and low production cost, and can realize all-round sealing between the atomization cotton and the e-liquid bin.

In the figures: 1 air inlet, 2 air inlet passage, 3 atomization member, 4 air outlet passage, 5 air outlet, 6 suction nozzle, 603 vent, 604 raised rib, 606 ring portion, 8 housing, 9 top cover, 903 e-liquid injection hole, 904 first limiting step, 905 limiting inner plane, 10 movable member, 1003 air passage hole, 1005 cylindrical portion, 1006 positioning plane, 12 e-liquid bin, 1201 locking column, 13 ultrasonic atomization sheet, 14 atomization cotton, 15 air inlet pipe, 16 first sealing ring, 17 bottom cover, 18 lower cover, 19 upper cover, 20 second sealing ring, 21 sealing gasket, 2101 through hole, 22 connection sleeve, 2201 e-liquid inlet, 2202 limiting outer plane, 23 inner sleeve, 24 outer sleeve, 2401 first e-liquid passage hole, 2402 locking hole, 25 cotton pressing spring, 26 atomization seat, 27 threaded seat, 28 lower electrode, 29 spring electrode, 30 insulating ring, 33 third sealing ring, 34 fourth sealing ring, 35 fifth sealing ring, 36 sixth sealing ring, 37 internal thread bushing, 3701 second limiting step, 3702 locking recess, 38 compression ring, 39 screw, 40 conductive sheet, 41 PCB, 44 pressure ring, 4401 first locking step, 4402 second locking step, 45 sealing sleeve, 4501 second e-liquid passage hole, 4502 boss, 4503 raised ring, 4403 limiting plane, 4404 first limiting slot, 46 sealing gasket, 4601 blind hole.

DETAILED DESCRIPTION OF EMBODIMENTS

Embodiment 1

Figure 1:
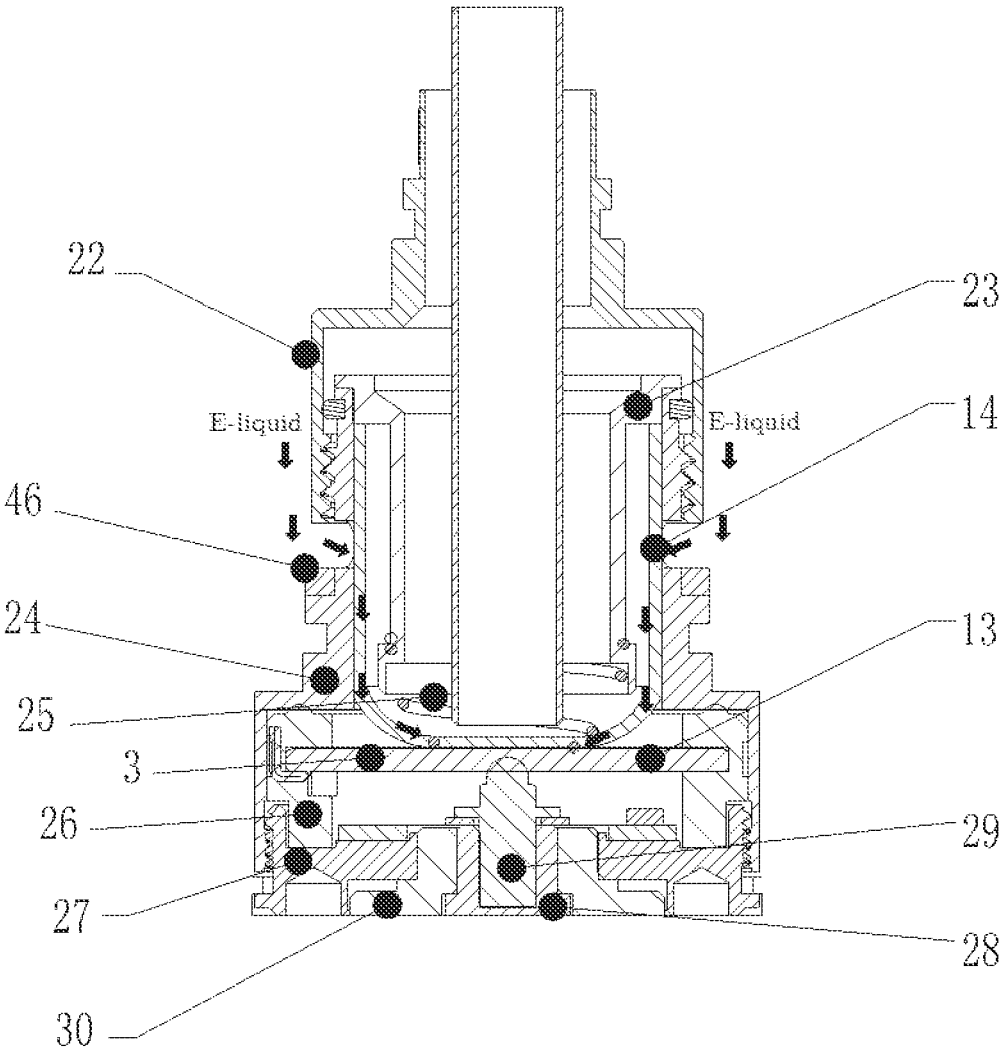
FIG. 1 is a schematic structural diagram of Embodiment 1 of an atomization core.
Figure 2:
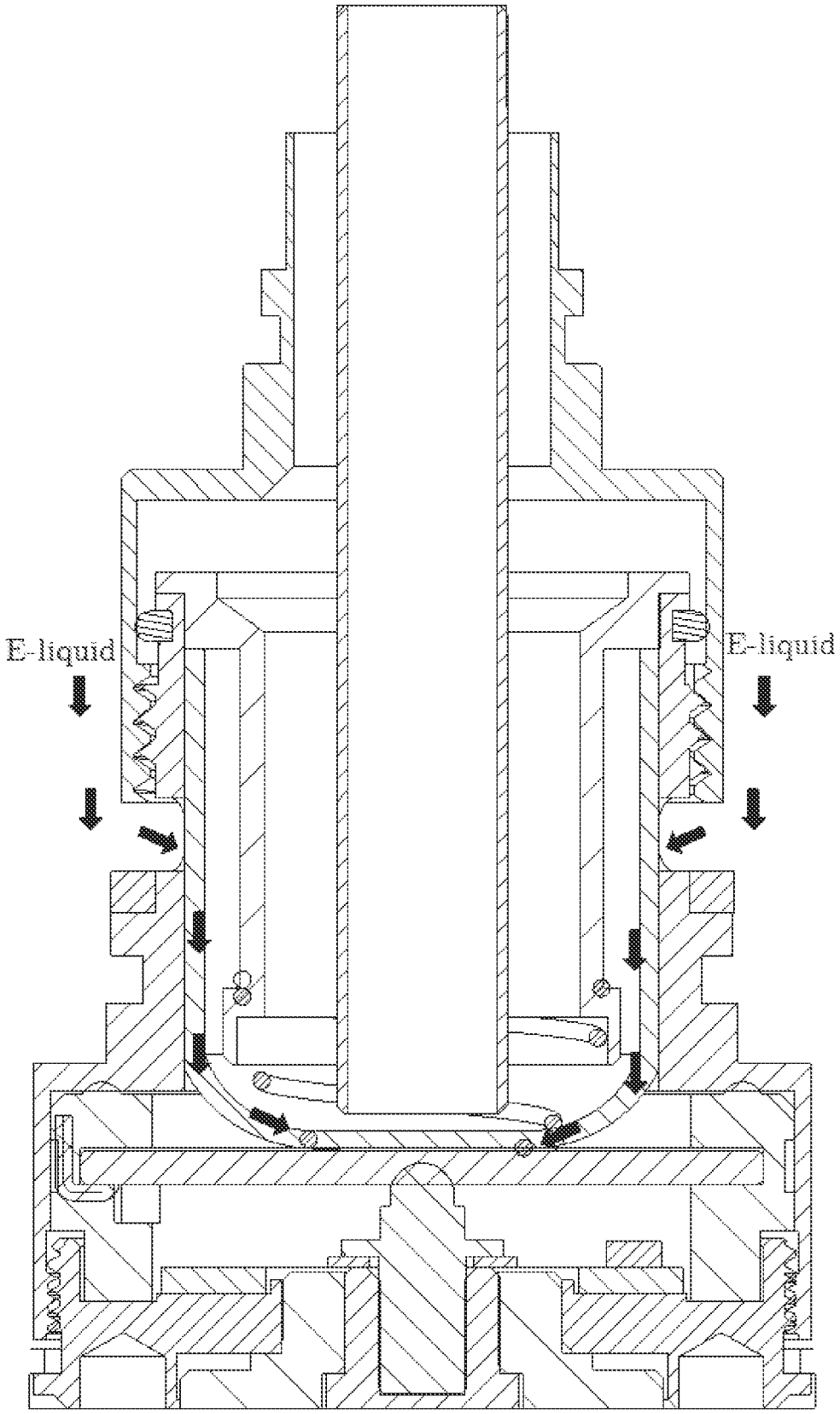
FIG. 2 is a schematic structural diagram of Embodiment 1 of the atomization core when an e-liquid passage is open.
Figure 3:
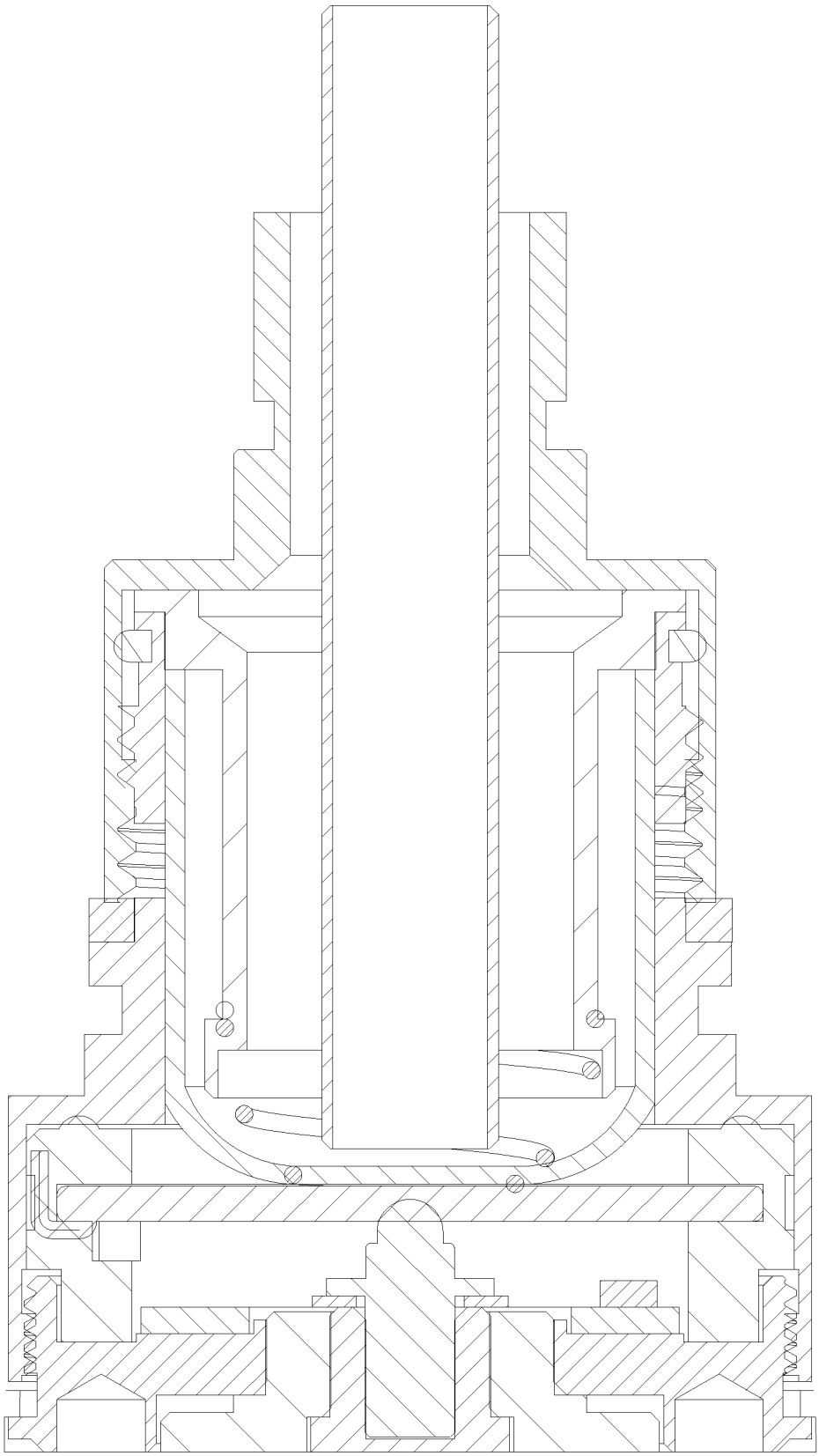
FIG. 3 is a schematic structural diagram of Embodiment 1 of the atomization core when the e-liquid passage is cut off.
Figure 4:
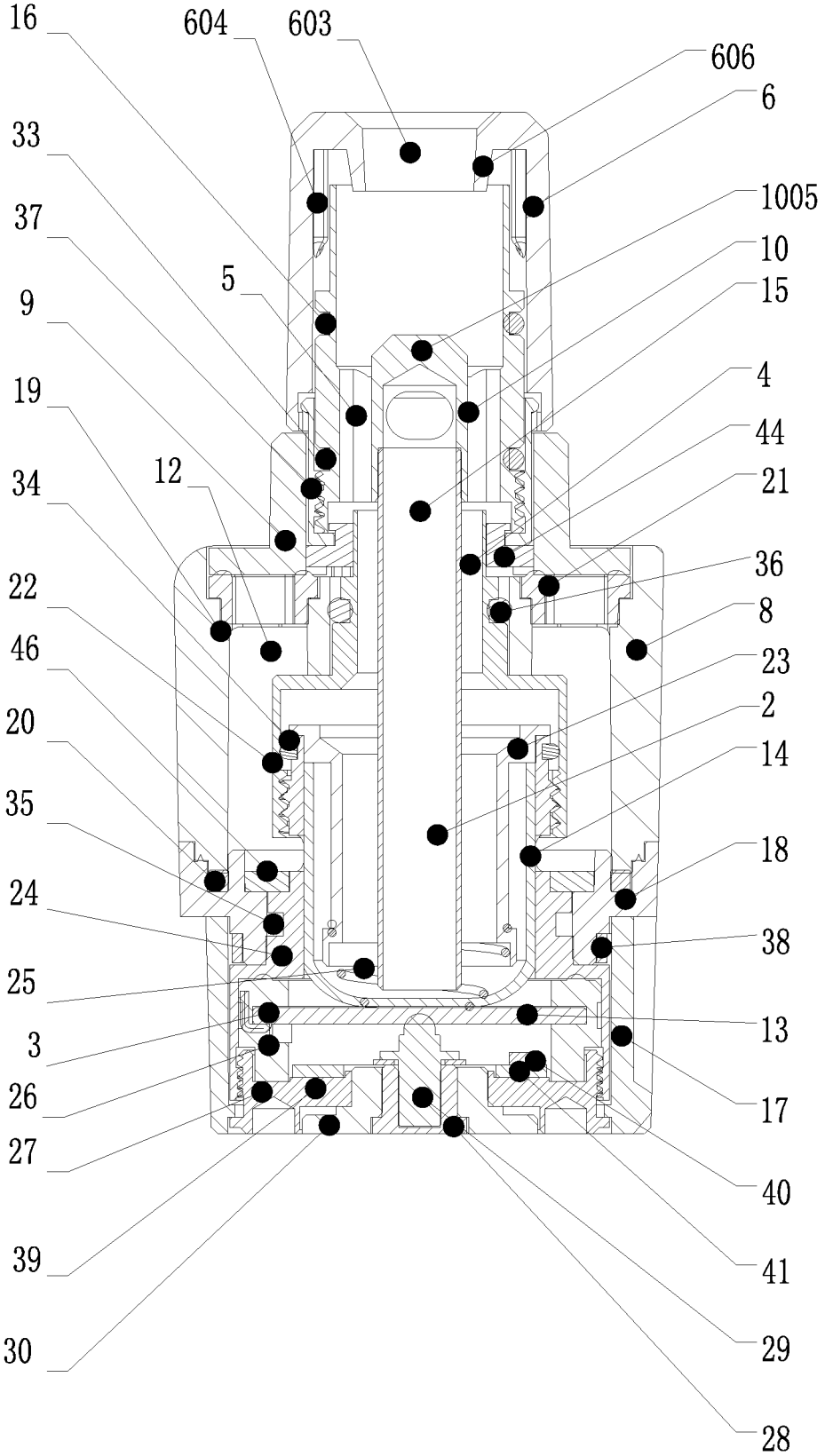
FIG. 4 is a schematic structural diagram of Embodiment 1 of an atomizer.
Figure 5:
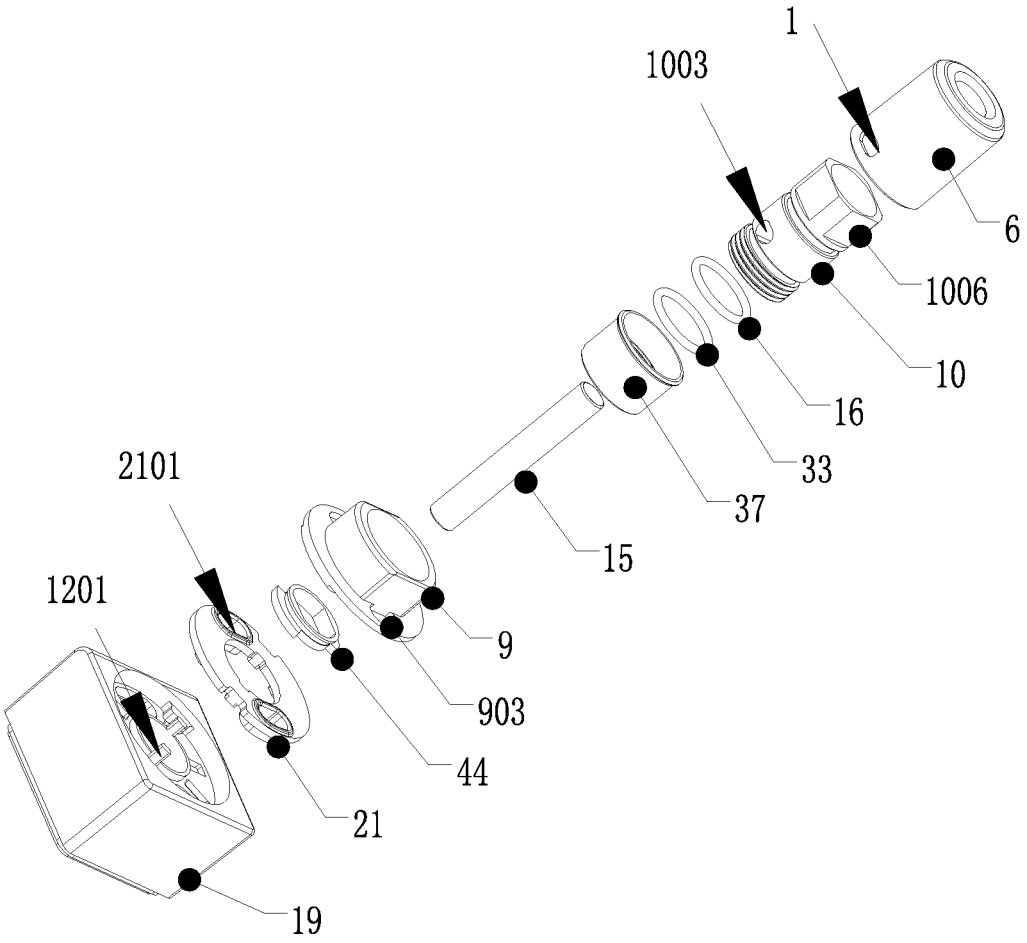
FIG. 5 is an exploded view of the upper part in FIG. 4.
Figure 6:
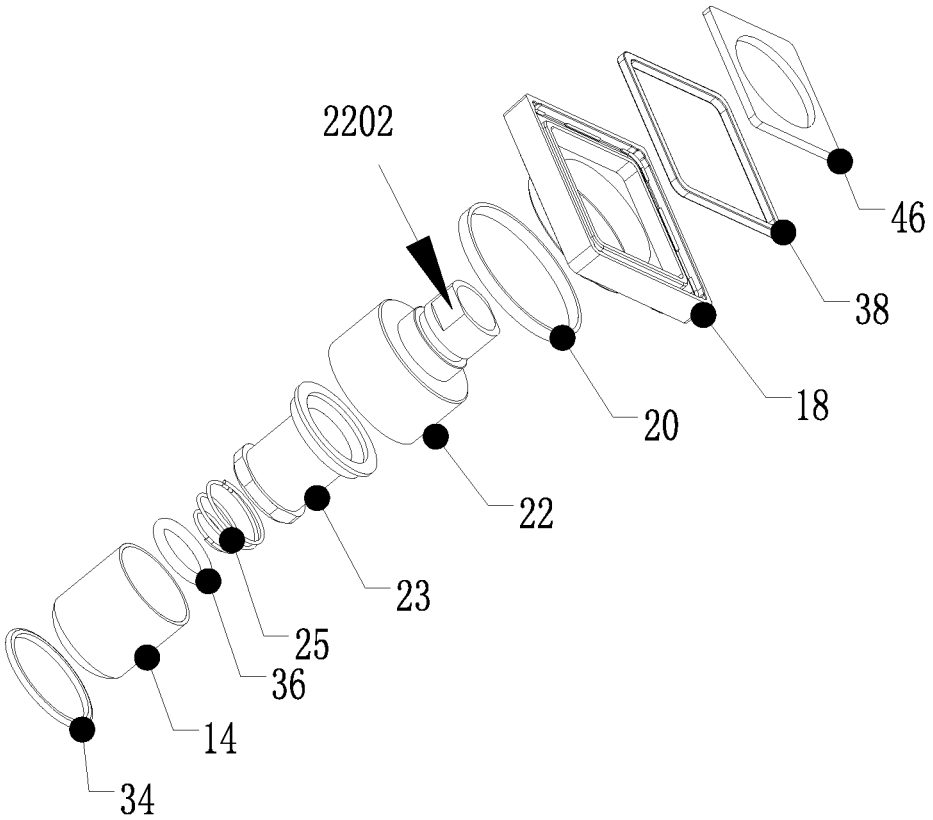
FIG. 6 is an exploded view of the middle part in FIG. 4.
Figure 7:
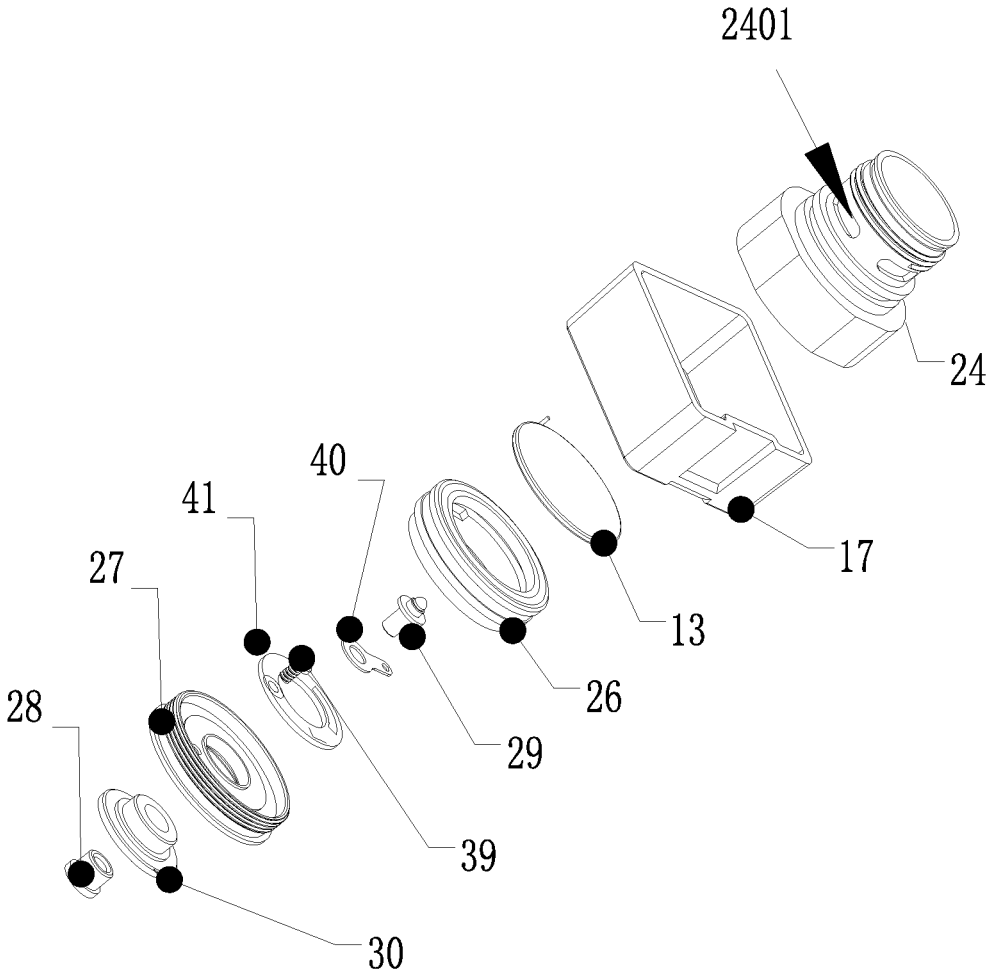
FIG. 7 is an exploded view of the lower part in FIG. 4.
Figure 8:
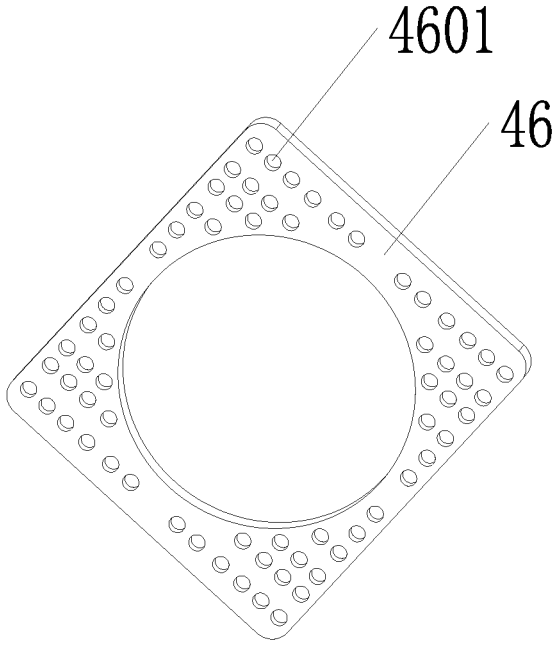
FIG. 8 is a schematic structural diagram of a bottom surface of a sealing gasket.
Figure 9:
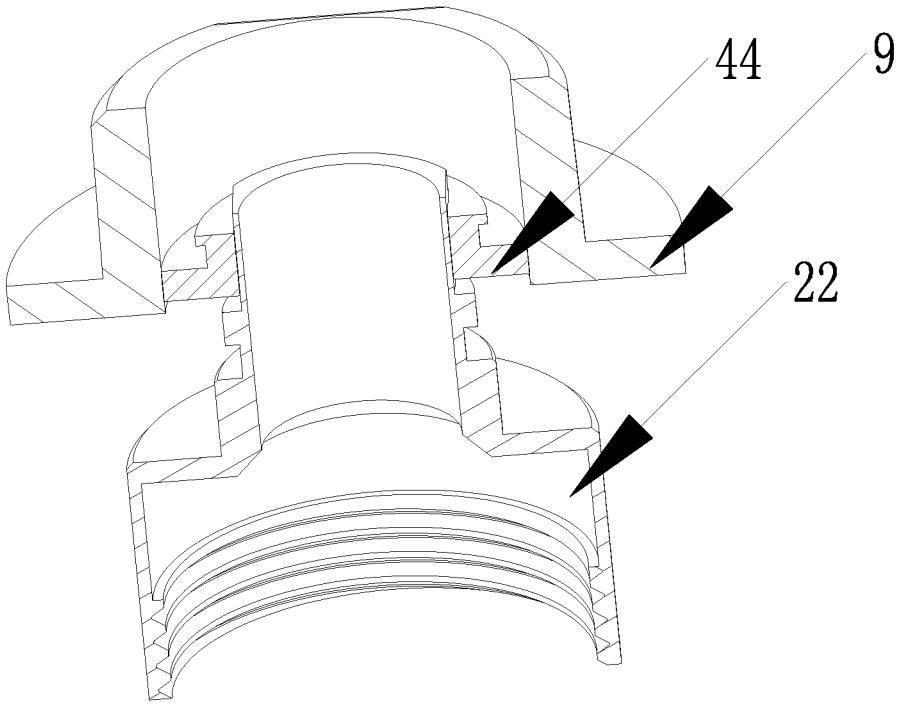
FIG. 9 is a connection structure diagram of a top cover, a pressure ring and a connection sleeve.
Figure 10:
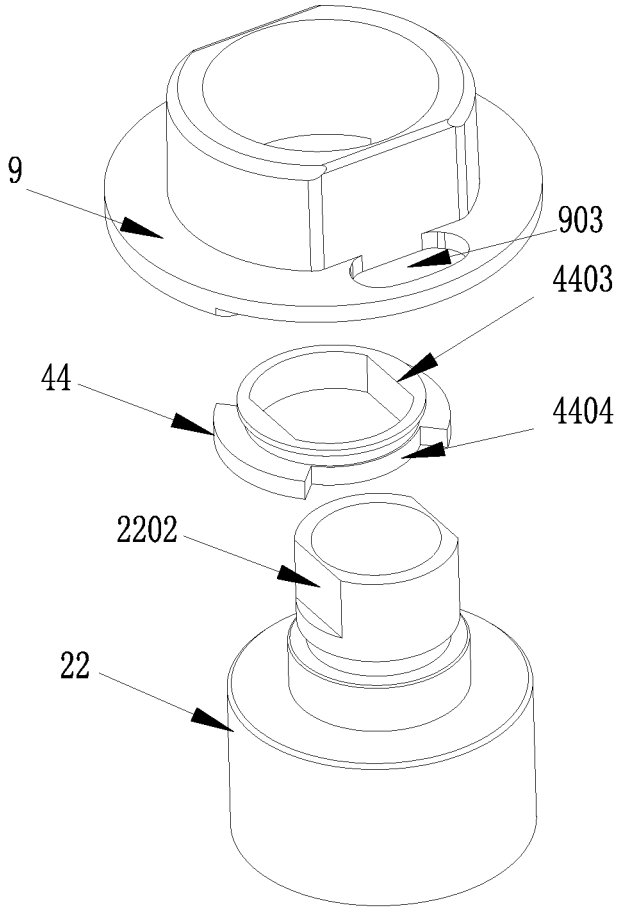
FIG. 10 is an exploded view of FIG. 9.
Figure 11:
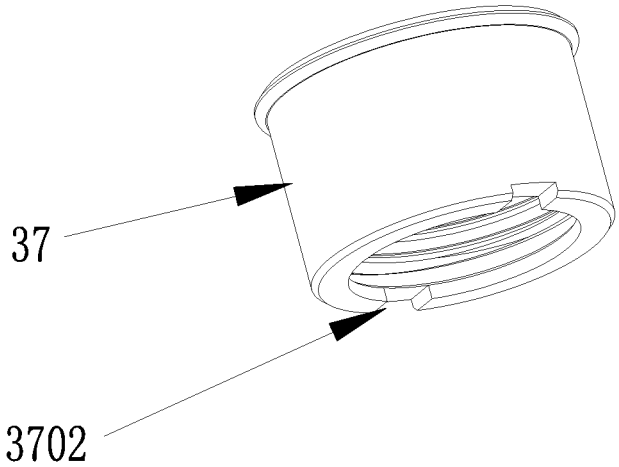
FIG. 11 is a schematic structural diagram of an internal thread bushing.
Figure 12:
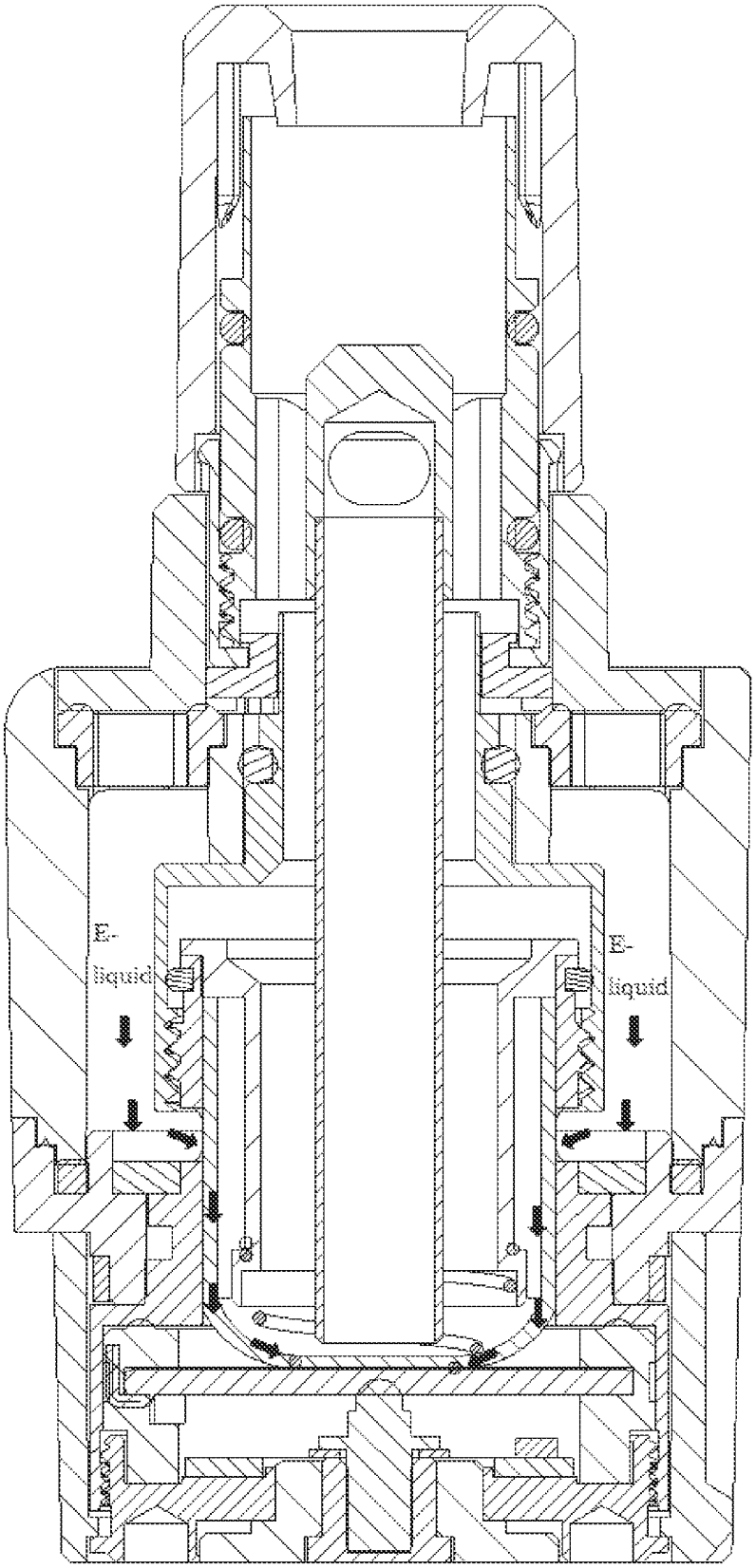
FIG. 12 is a schematic structural diagram of Embodiment 1 of the atomizer when an e-liquid injection hole is closed.
Figure 13:
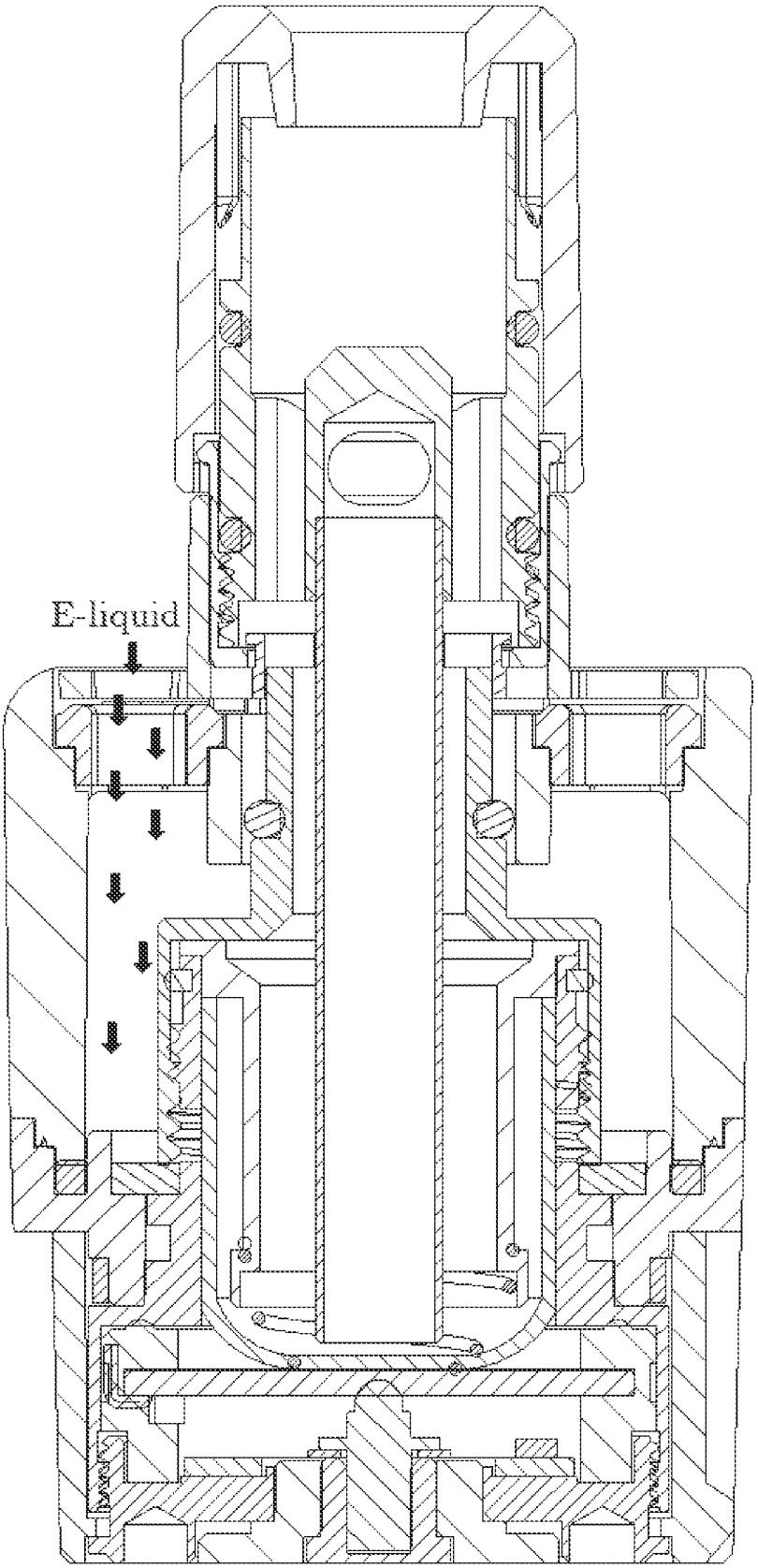
FIG. 13 is a schematic structural diagram of Embodiment 1 of the atomizer when the e-liquid injection hole is opened.

As shown in FIG. 1 to FIG. 13, an electronic cigarette atomization core comprises an atomization member 3, an outer sleeve 24, a connection sleeve 22, and atomization cotton 14, a lower segment of the connection sleeve 22 is sleeved outside an upper segment of the outer sleeve 24, the outer sleeve 24 is sleeved outside the atomization cotton 14, and the outer sleeve 24 is provided with a first e-liquid passage hole 2401 capable of communicating an inner cavity of an electronic cigarette e-liquid bin 12 with the atomization cotton 14; the connection sleeve 22 is axially movable relative to the outer sleeve 24 to close or open the first e-liquid passage hole 2401, and a buffer sealing structure for sealing the first e-liquid passage hole 2401 when the first e-liquid passage hole 2401 is closed is arranged between the connection sleeve 22 and the outer sleeve 24.

When an e-liquid passage needs to be cut off (for example, when e-liquid is injected and when an electronic cigarette is in a standing state for a long time), the connection sleeve 22 is driven to move axially relative to the outer sleeve 24 to close or open the first e-liquid passage hole 2401. Because the buffer sealing structure is arranged between the connection sleeve 22 and the outer sleeve 24, the requirement for the matching dimensional precision of the connection sleeve 22 and the outer sleeve 24 is low, the assembly is convenient, the production time is short, the production cost is low, the sealing effect is good, and the risks of e-liquid leakage and e-liquid suction are avoided.

The buffer sealing structure comprises a sealing gasket 46 fixedly sleeved outside a lower segment of the outer sleeve 24, and the sealing gasket 46 is made of silica gel. A top surface of the sealing gasket 46 is below a lowest point of the first e-liquid passage hole 2401 or tangent to the lowest point of the first e-liquid passage hole 2401; when the connection sleeve 22 moves in the axial direction of the electronic cigarette until a bottom end of the connection sleeve 22 abuts against the sealing gasket 46, the first e-liquid passage hole 2401 is closed; and when the connection sleeve 22 moves in the axial direction of the electronic cigarette until the bottom end of the connection sleeve 22 separates from the sealing gasket 46, the first e-liquid passage hole 2401 is opened.

When the e-liquid passage needs to be cut off, for example, when e-liquid is injected and when the electronic cigarette is in a standing state for a long time, the connection sleeve 22 is driven to move close to the sealing gasket 46 in the axial direction of the electronic cigarette, and the connection sleeve 22 finally abuts on the sealing gasket 46, so that the first e-liquid passage hole 2401 is closed, the e-liquid passage is cut off, and the inner cavity of the e-liquid bin 12 and the atomization cotton 14 are in a cut-off state. When the e-liquid passage needs to be opened, the connection sleeve 22 is driven to move away from the sealing gasket 46 in the axial direction of the electronic cigarette, the first e-liquid passage hole 2401 is finally opened, the e-liquid passage is open, and the inner cavity of the e-liquid bin 12 and the atomization cotton 14 are in a communication state.

A bottom surface of the sealing gasket 46 is provided with a force deformation structure. The force deformation structure comprises a blind hole 4601 arranged on the bottom surface of the sealing gasket 46 (the bottom surface is on a side away from an e-liquid cavity), which is beneficial to the deformation of the sealing gasket 46 when the connection sleeve 22 moves close to the sealing gasket 46 in the axial direction of the electronic cigarette and squeezes the sealing gasket 46, so the sealing effect is the best at this time, and the e-liquid passage communicating the first e-liquid passage hole 2401 with the e-liquid bin is completely cut off.

An electronic cigarette atomizer comprises a housing 8, and the electronic cigarette atomization core in Embodiment 1 is arranged in the housing 8. A top cover 9 is arranged at a top of the housing 8, and the e-liquid bin 12 is arranged in the housing 8.

The top cover 9 rotates to drive the connection sleeve 22 to move in the axial direction of the electronic cigarette; when the bottom end of the connection sleeve 22 abuts against the sealing gasket 46, the first e-liquid passage hole 2401 is closed; and when the bottom end of the connection sleeve 22 separates from the sealing gasket 46, the first e-liquid passage hole 2401 is opened.

When the e-liquid passage needs to be cut off (for example, when e-liquid is injected and when the electronic cigarette is in a standing state for a long time, the top cover 9 is rotated to drive the connection sleeve 22 to move close to the sealing gasket 46 in the axial direction of the electronic cigarette, and the connection sleeve 22 finally abuts on the sealing gasket 46, so that the first e-liquid passage hole 2401 is closed, the e-liquid passage is cut off, and the inner cavity of the e-liquid bin 12 and the atomization cotton 14 are in a cut-off state. When the e-liquid passage needs to be opened, the top cover 9 is rotated to drive the connection sleeve 22 to move away from the sealing gasket 46 in the axial direction of the electronic cigarette, the first e-liquid passage hole 2401 is finally opened, the e-liquid passage is open, and the inner cavity of the e-liquid bin 12 and the atomization cotton 14 are in a communication state. Due to the sealing effect of the sealing gasket 46, the requirement for the matching dimensional precision of the connection sleeve 22 and the outer sleeve 24 is low, the assembly is convenient, the production time is short, the production cost is low, the sealing effect is good, and the risks of e-liquid leakage and e-liquid suction are avoided.

The electronic cigarette atomizer further comprises a pressure ring 44 riveted to the top cover 9, the pressure ring 44 is sleeved outside an upper segment of the connection sleeve 22, an inner side wall of the pressure ring 44 is provided with a limiting plane 4403 for limiting the circumferential rotation of the connection sleeve 22, and an outer side wall of the connection sleeve 22 is provided with a limiting outer plane 2202 matching the limiting plane 4403; and the top cover 9 rotates to drive the connection sleeve 22 through the pressure ring 44 to move in the axial direction of the electronic cigarette.

Since the pressure ring 44 is riveted to the top cover 9, the pressure ring 44 and the top cover 9 form a whole. Through the cooperation of the limiting plane 4403 and the limiting outer plane 2202, when the top cover 9 is rotated, the pressure ring 44 limits the circumferential rotation of the connection sleeve 22 to ensure the axial movement of the connection sleeve 22, thereby opening or closing the e-liquid passage.

The housing 8 is provided with an air inlet passage 2 and an air outlet passage 4 therein, and a suction nozzle 6 is sleeved outside the top cover 9 and is rotatable relative to the top cover 9; an air inlet 1, the air inlet passage 2, the atomization member 3, the air outlet passage 4, an air outlet 5, and the suction nozzle 6 are communicated in sequence; a movable member 10 and an internal thread bushing 37 are arranged in the top cover 9, the internal thread bushing 37 is placed on the pressure ring 44, and a lower segment of a side wall of the movable member 10 is in threaded connection with the internal thread bushing 37; the rotation of the suction nozzle 6 drives the movable member 10 to rotate relative to threads of the internal thread bushing 37 and to move axially along the top cover 9; the movable member 10 is provided with an air passage hole 1003 communicating the air inlet 1 with the air inlet passage 2, and when the movable member 10 moves axially along the top cover 9, an inner side wall of the internal thread bushing 37 is displaced to block part of or whole of the air passage hole 1003 to adjust the amount of air entering the air inlet passage 2; the top cover 9 is provided with an e-liquid injection hole 903 for injecting e-liquid into the e-liquid bin 12, and the top cover 9 is in clearance fit with the internal thread bushing 37.

The pressure ring 44 can limit the axial movement of the internal thread bushing 37. When the suction nozzle 6 is rotated, the movable member 10 moves axially under the drive of the suction nozzle 6, thereby adjusting the area of the air passage hole 1003 that is blocked by the internal thread bushing 37. The misaligned movement of the air passage hole 1003 on the movable member 10 relative to the air inlet 1 increases or decreases the air flow passing through the air passage hole 1003 in a unit time, so the adjustment is convenient, and the sealing performance is good. Since the holding area of the suction nozzle 6 is large, the rotation force during the rotation can be conveniently controlled, and the operation is simple and reliable. At the same time, since the top cover 9 is in clearance fit with the internal thread bushing 37, the top cover 9 does not rotate during the process of air adjustment, the e-liquid injection hole 903 is not opened during the air adjustment, and e-liquid leakage of the e-liquid bin 12 is avoided or suction of the e-liquid due to fast e-liquid supply is avoided. Even if the suction nozzle 6 is rotated to an extreme position during the air adjustment, the top cover 9 will not be driven to rotate, and the e-liquid injection hole 903 will not be opened by mistake during the air adjustment.

A bottom of the internal thread bushing 37 is provided with at least two locking recesses 3702 for limiting the circumferential rotation of the internal thread bushing 37, the e-liquid bin 12 is provided with a locking column 1201 parallel to the axis of the electronic cigarette and matching the locking recess 3702, a first limiting slot 4404 is formed on the outer circumference of the pressure ring 44, and the locking column 1201 passes through the first limiting slot 4404 and is locked into the locking recess 3702.

The locking column 1201 cooperates with the locking recess 3702 to limit the circumferential rotation of the internal thread bushing 37, so that when the air is adjusted by rotating the suction nozzle 6, the internal thread bushing 37 cannot be rotated, and the e-liquid injection operation and the air adjustment operation are absolutely separated without affecting each other.

At least two raised ribs 604 parallel to the axis of the suction nozzle 6 are uniformly arranged on the circumference of the inner side wall of the suction nozzle 6, and the outer side wall of the movable member 10 has positioning planes 1006 corresponding to the raised ribs 604 one to one.

The raised ribs 604 cooperate with the positioning planes 1006 to achieve a rotation linkage effect.

An inner sleeve 23 is further arranged in the connection sleeve 22, the outer sleeve 24 is sleeved outside the inner sleeve 23, the atomization cotton 14 is cup-shaped, and the side wall of the atomization cotton 14 is sandwiched between the inner sleeve 23 and the outer sleeve 24.

A first sealing ring 16 is arranged between the movable member 10 and the top cover 9. The air inlet 1 is formed on a side wall of the suction nozzle 6.

An air inlet pipe 15 is further arranged in the housing 8, and an inner cavity of the air inlet pipe 15 forms the air inlet passage 2; an air inlet end of the air inlet pipe 15 is connected to the movable member 10, and an air outlet end of the air inlet pipe 15 is opposite to the atomization member 3. In this embodiment, the atomization member 3 comprises an ultrasonic atomization sheet 13. The air outlet end of the air inlet pipe 15 is opposite to the atomization cotton 14 on the atomization surface of the ultrasonic atomization sheet 13. The ultrasonic atomization sheet 13 is a piezoelectric ceramic sheet.

Since the air inlet end of the air inlet pipe 15 is connected to the movable member 10, the movable member 10 drives the air inlet pipe 15 to move during movement, so that the relative positions of the air outlet end of the air inlet pipe 15 and the ultrasonic atomization sheet 13 are changed. When the air inlet volume is adjusted small, the distance between the air outlet end of the air inlet pipe 15 and the ultrasonic atomization sheet 13 is relatively short, so the impact of air flow is large, the smoke emitting effect is good, the concentration of smoke is not reduced while the air is adjusted, and the use is not affected.

The inside of a vent 603 at the top of the suction nozzle 6 has a ring portion 606 extending toward the inside of the suction nozzle 6 to prevent the condensed e-liquid from being sucked out.

The movable member 10 has a cylindrical portion 1005 opposite to the vent 603. The cylindrical portion 1005 can play a role of drainage, which can effectively help the condensed e-liquid at the suction nozzle 6 to flow back, thereby alleviating the condensation of the e-liquid at the suction nozzle 6.

The top of the cylindrical portion 1005 is a tip with an oblique angle, so that the drainage effect is better.

The housing 8 comprises a bottom cover 17, a lower cover 18, and an upper cover 19 connected sequentially from bottom to top. A second sealing ring 20 is arranged between the lower cover 18 and the upper cover 19. A compression ring 38 is arranged between the lower cover 18 and the bottom cover 17. A third sealing ring 33 is arranged between the movable member 10 and the internal thread bushing 37. The air inlet passage 2 and the air outlet passage 4 have good sealing effect, and do not leak air.

The top cover 9 is connected to a top of the upper cover 19. The e-liquid bin 12 is arranged in the top cover 9. A sealing member 21 is arranged between the top of the e-liquid bin 12 and the top cover 9. The sealing member 21 is provided with a through hole 2101 capable of communicating the e-liquid injection hole 903 with the e-liquid bin 12. When no e-liquid is injected, the e-liquid injection hole 903 is misaligned with the through hole 2101, and the e-liquid injection hole 903 is closed to prevent e-liquid leakage from the e-liquid bin 12. When e-liquid is injected, the top cover 9 is rotated to communicate the e-liquid injection hole 903 with the through hole 2101, and the e-liquid injection hole 903 is opened to inject the e-liquid into the e-liquid bin 12. A fourth sealing ring 34 is arranged between the outer sleeve 24 and the connection sleeve 22 to better cut off the e-liquid passage during the e-liquid injection process. A fifth sealing ring 35 is arranged between the outer sleeve 24 and the lower cover 18. A sixth sealing ring 36 is arranged between the connection sleeve 22 and the upper cover 19.

An outer bottom surface of the cup-shaped atomization cotton 14 is in contact with the ultrasonic atomization sheet 13. A lower segment of the air inlet pipe 15 extends into the inner sleeve 23 and an outlet of the lower segment of the air inlet pipe 15 is opposite to an inner bottom surface of the atomization cotton 14. A cotton pressing spring 25 is further arranged in the cup-shaped atomization cotton 14, one end of the cotton pressing spring 25 abuts against the inner sleeve 23, and the other end of the cotton pressing spring 25 abuts against the inner bottom surface of the cup-shaped atomization cotton 14.

The ultrasonic atomization sheet 13 is fixed in the bottom cover 17 through an atomization seat 26.

A bottom of the bottom cover 17 is provided with a threaded seat 27 for sealing.

A lower electrode 28 is arranged in the threaded seat 27, and the lower electrode 28 abuts against the ultrasonic atomization sheet 13 through a spring electrode 29. The spring electrode 29 is electrically connected to a PCB 41 through a conductive sheet 40. The PCB 41 is connected to the threaded seat 27 by a screw 39. The lower electrode 28 is connected to the threaded seat 27 in an insulating manner by an insulating ring 30.

Embodiment 2

Figure 14:
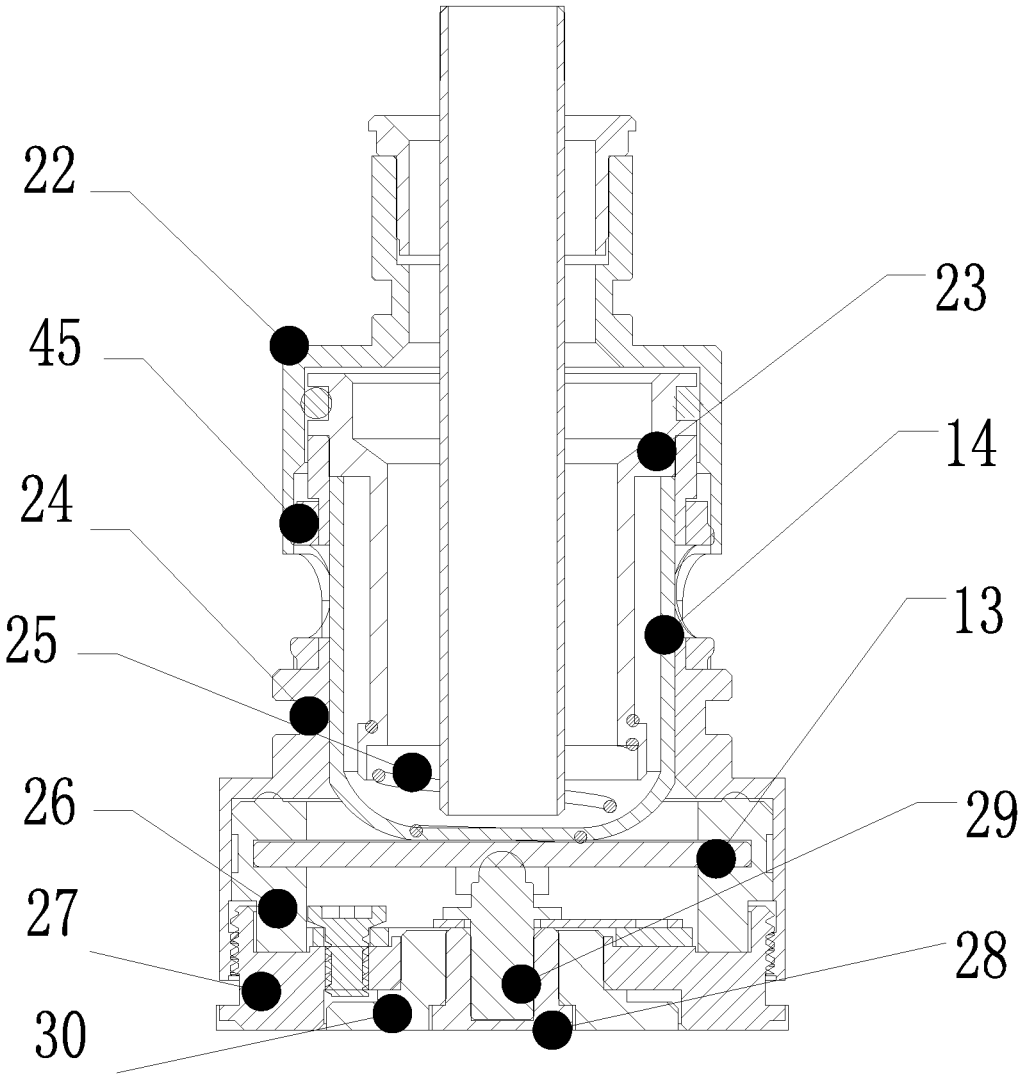
FIG. 14 is a schematic structural diagram of Embodiment 2 of an atomization core.
Figure 15:
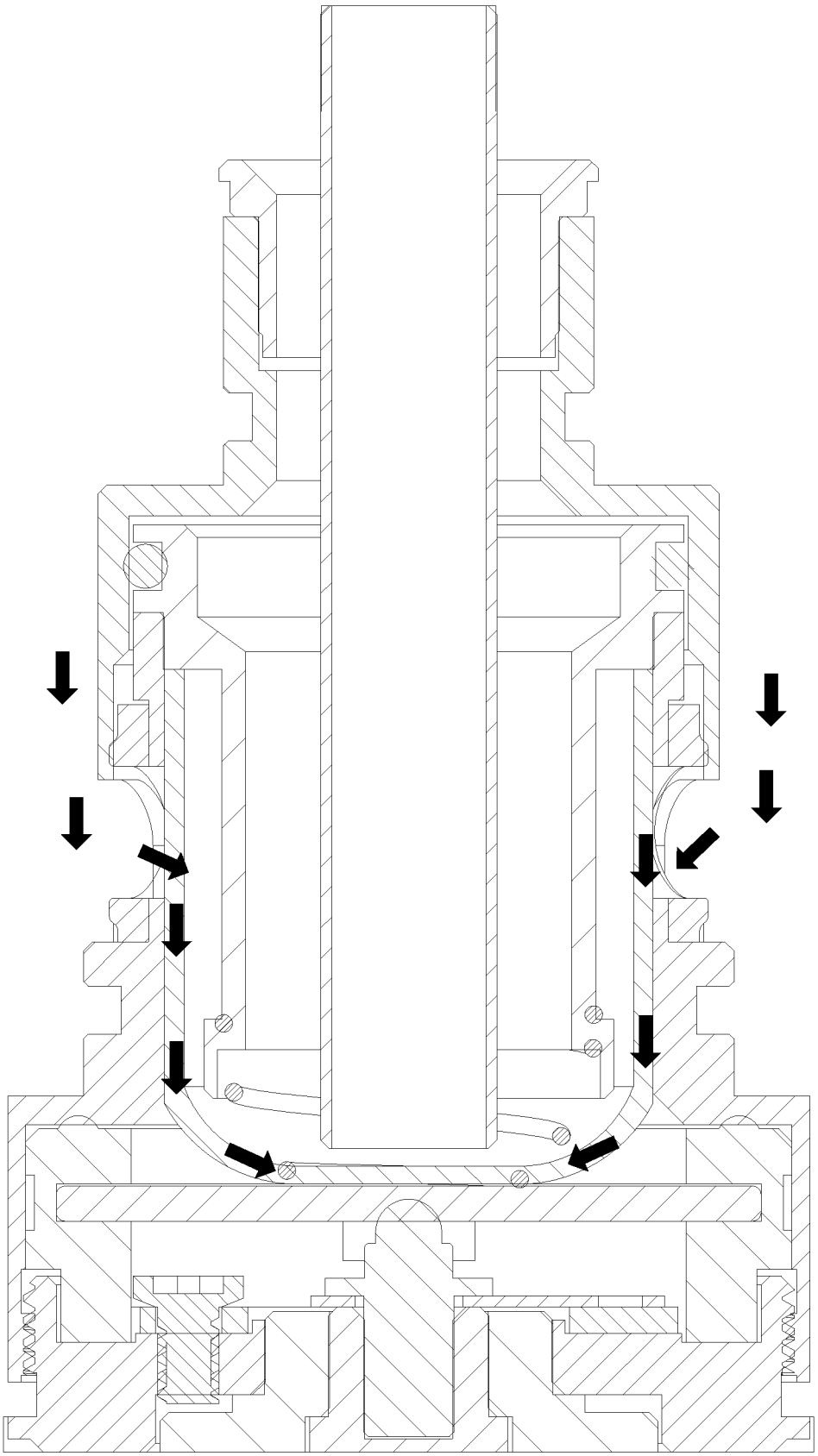
FIG. 15 is a schematic structural diagram of Embodiment 2 of the atomization core when an e-liquid passage is open.
Figure 16:
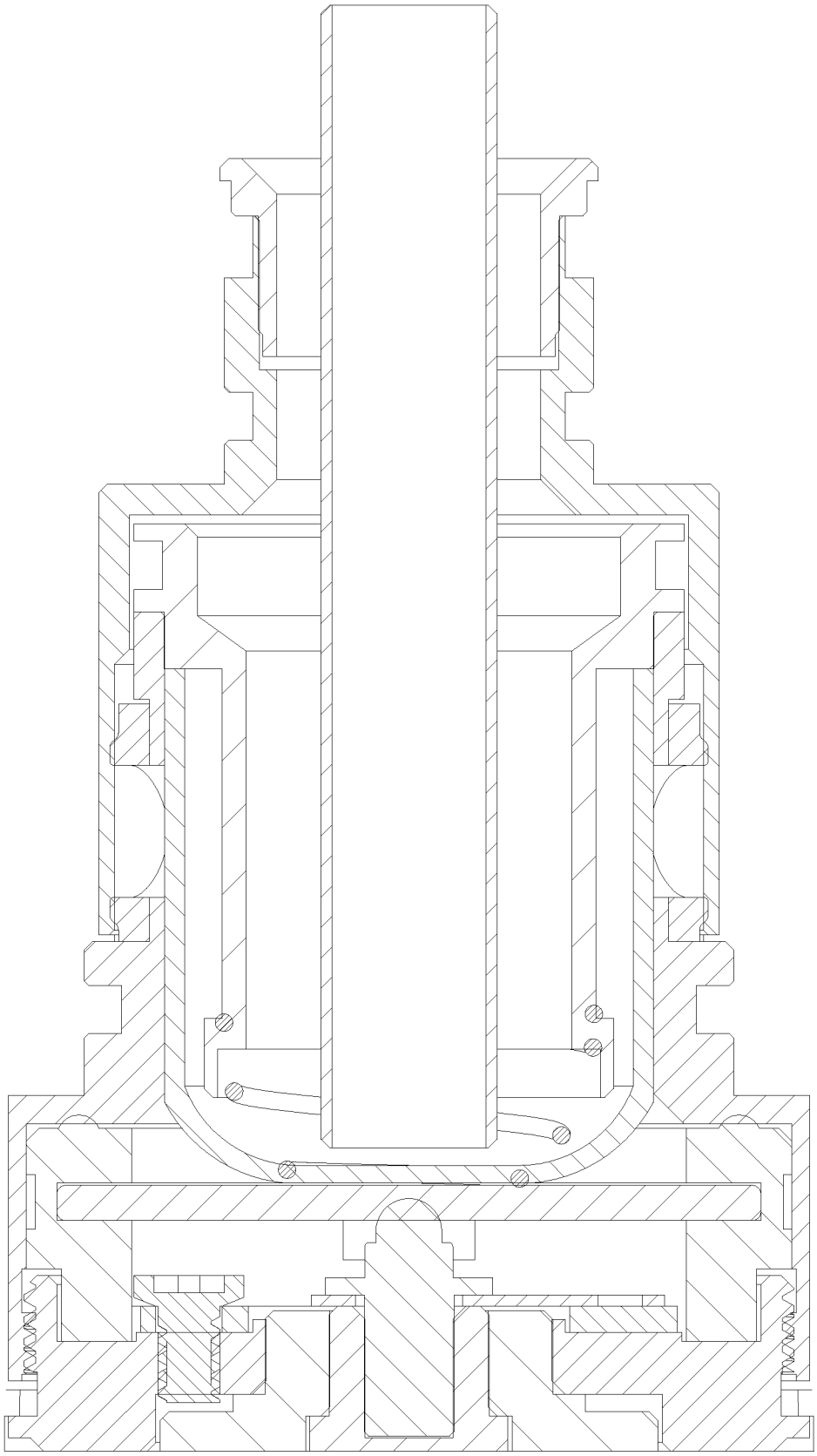
FIG. 16 is a schematic structural diagram of Embodiment 2 of the atomization core when the e-liquid passage is cut off.
Figure 17:
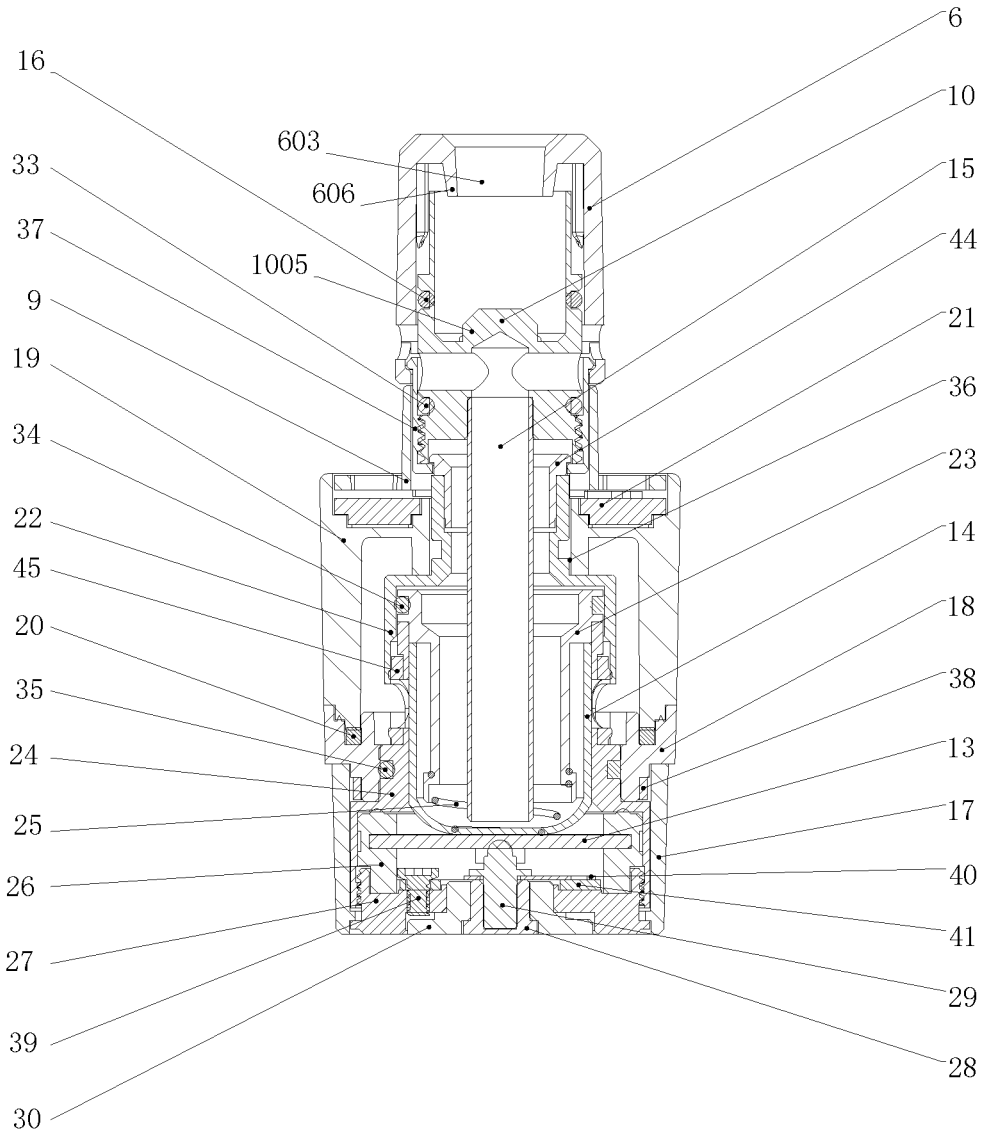
FIG. 17 is a schematic structural diagram of Embodiment 2 of an atomizer.
Figure 18:
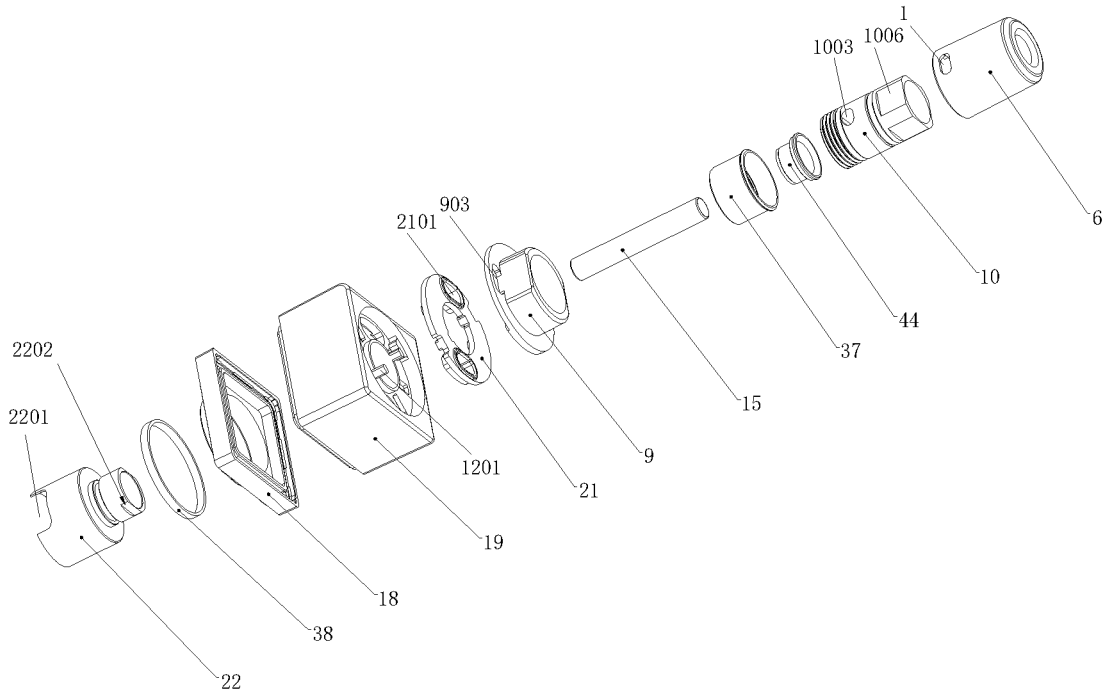
FIG. 18 is an exploded view of the upper part in FIG. 17.
Figure 19:
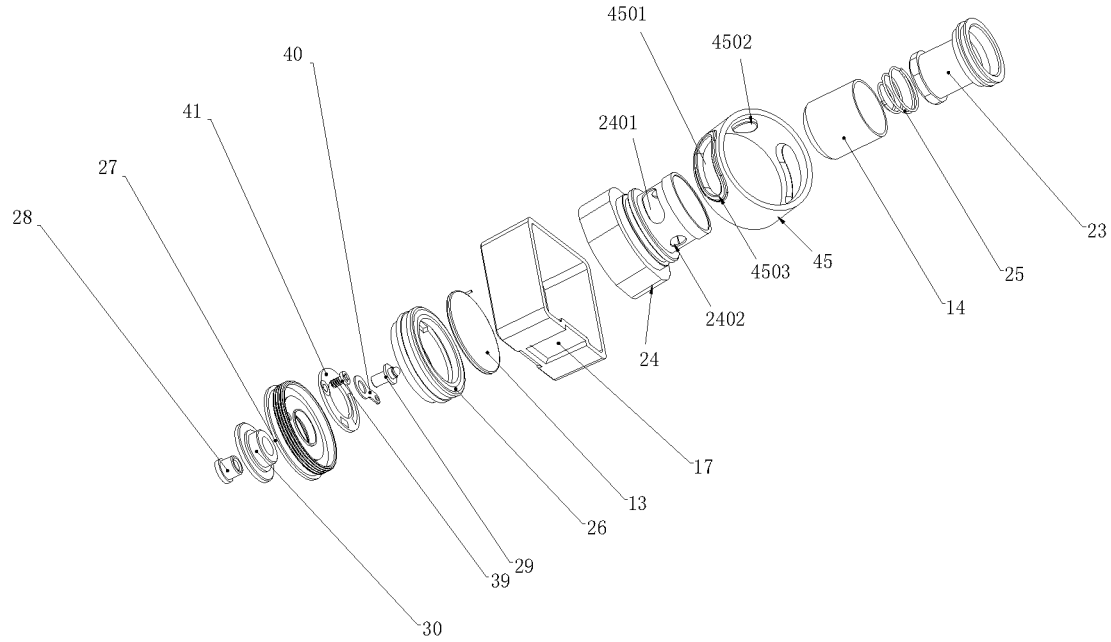
FIG. 19 is an exploded view of the lower part in FIG. 17.
Figure 20:
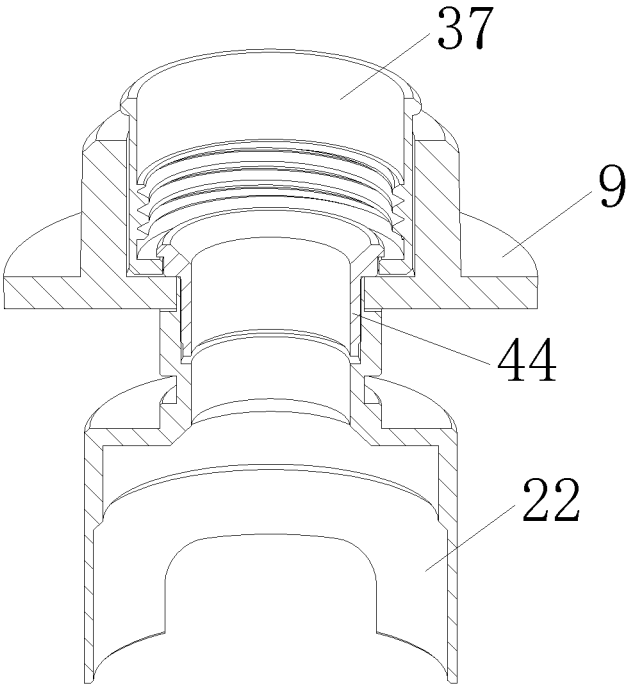
FIG. 20 is a connection structure diagram of a top cover, an internal thread bushing, a pressure ring and a connection sleeve.
Figure 21:
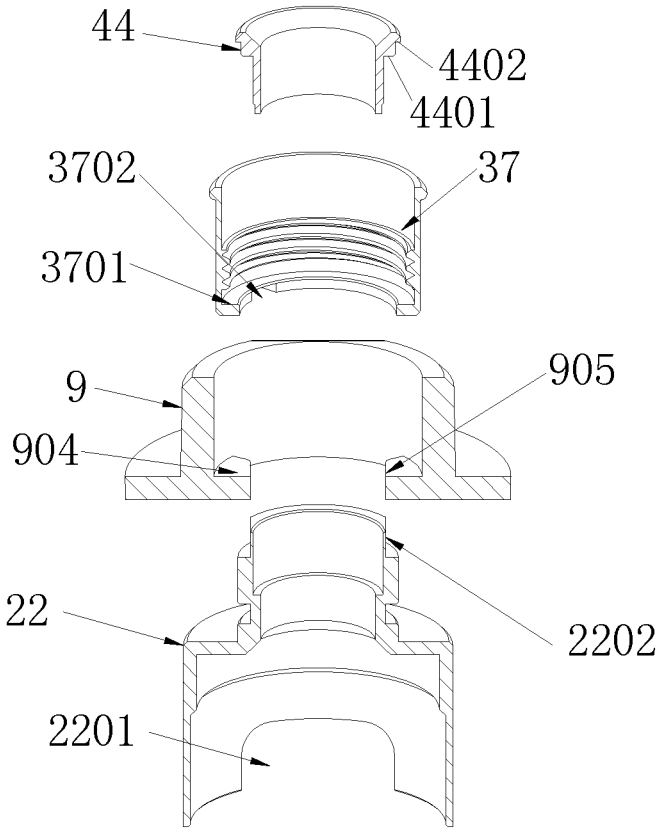
FIG. 21 is an exploded view of FIG. 20.
Figure 22:
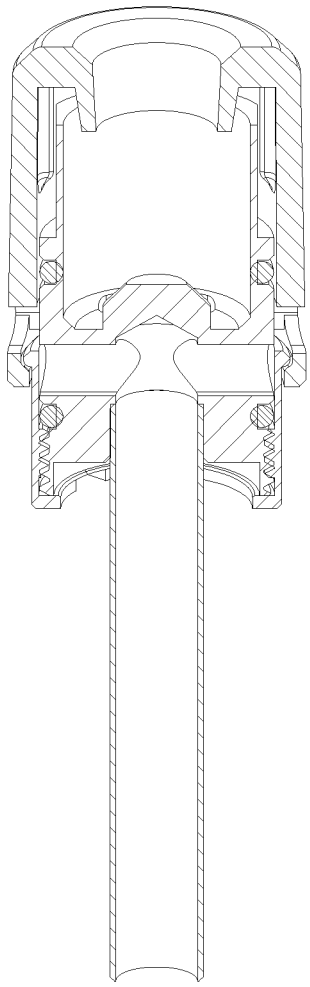
FIG. 22 is a connection structure diagram of a suction nozzle, the internal thread bushing and a movable member.
Figure 23:
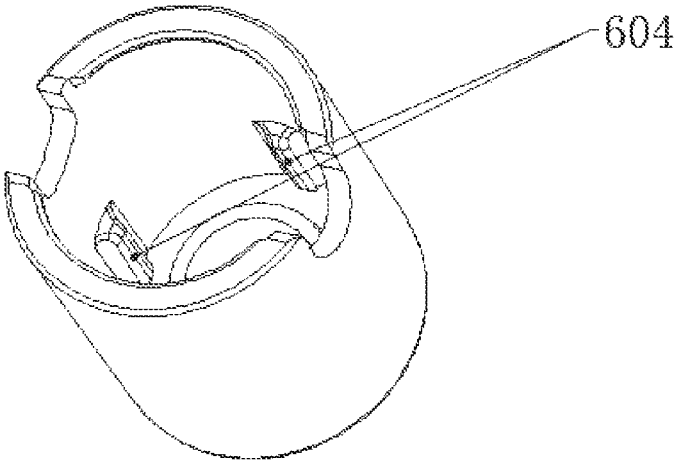
FIG. 23 is a schematic structural diagram of the suction nozzle.
Figure 24:
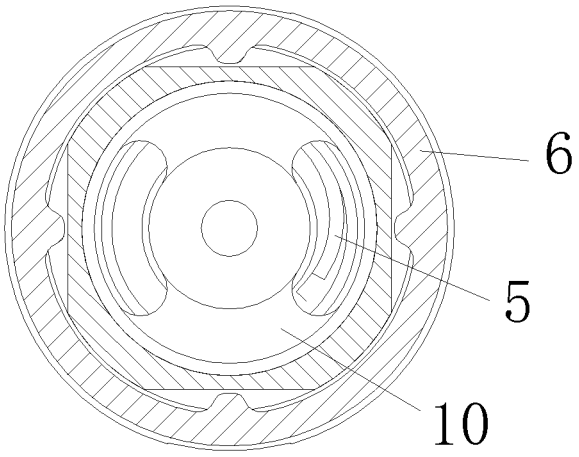
FIG. 24 is a connection structure diagram of the suction nozzle and the movable member.
Figure 25:
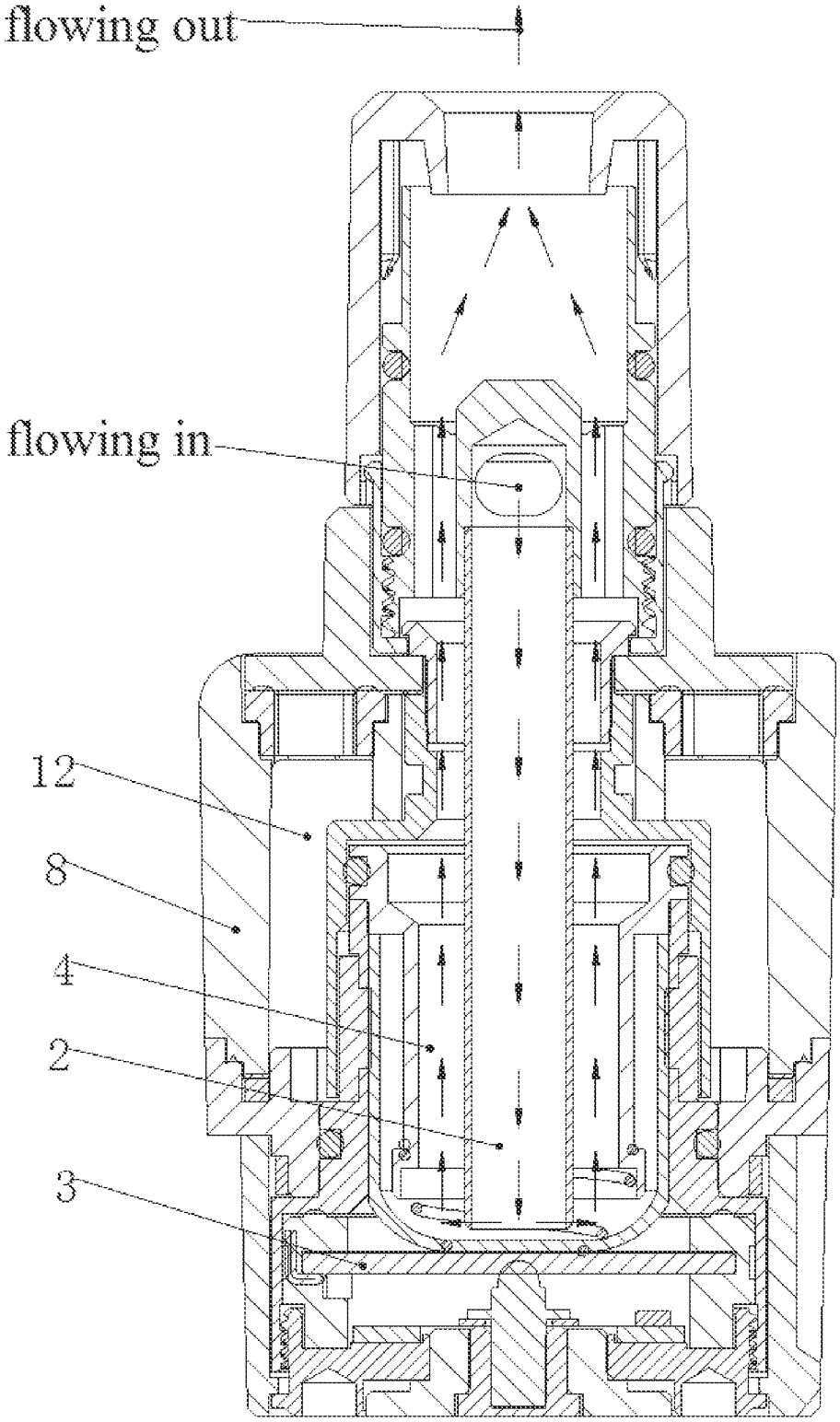
FIG. 25 is a schematic diagram of an air flow direction in Embodiment 2 of the atomizer.
Figure 26:
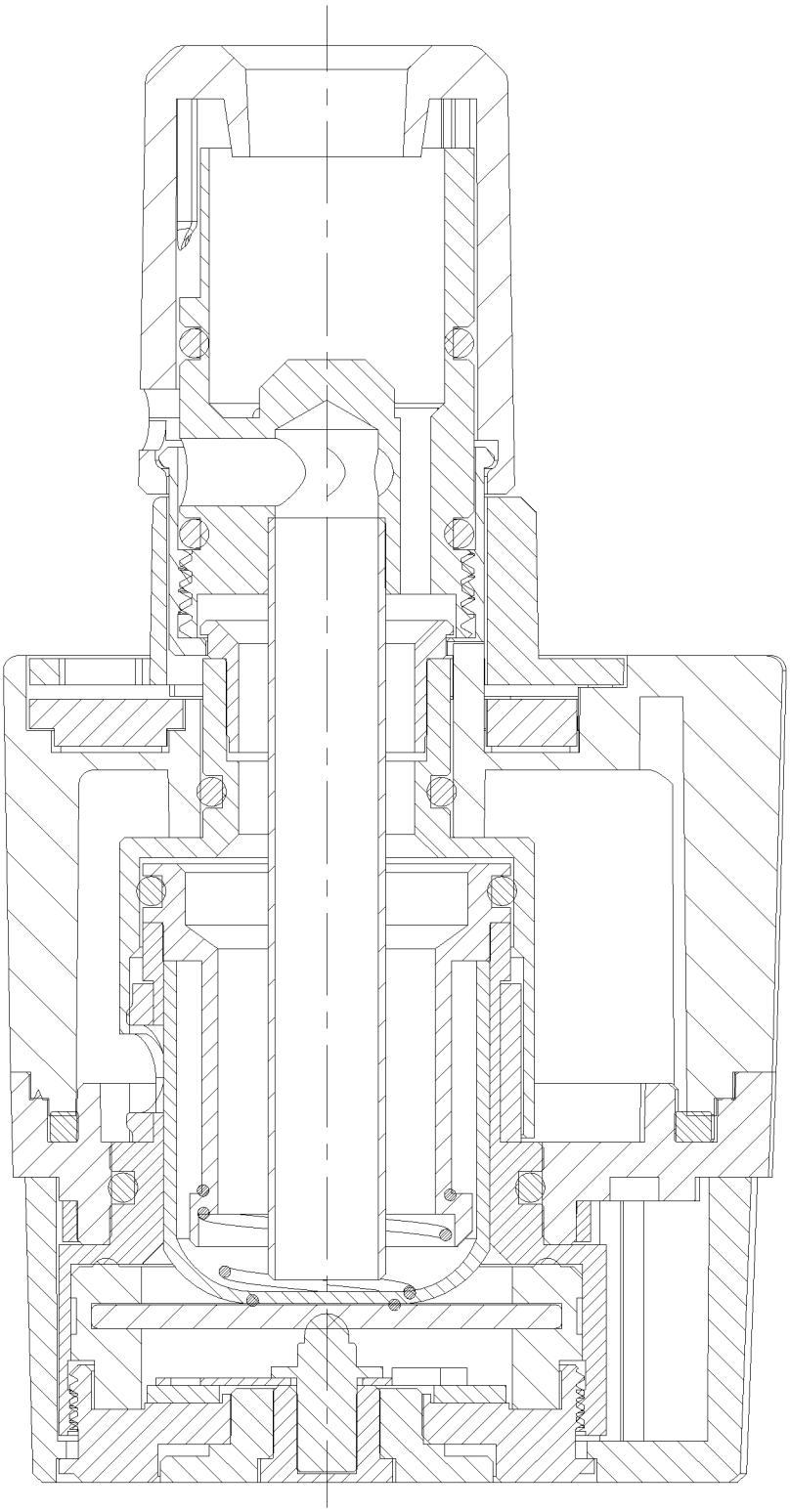
FIG. 26 is a schematic structural diagram of Embodiment 2 of the atomizer when an e-liquid injection hole is closed and an e-liquid inlet is opened.
Figure 27:
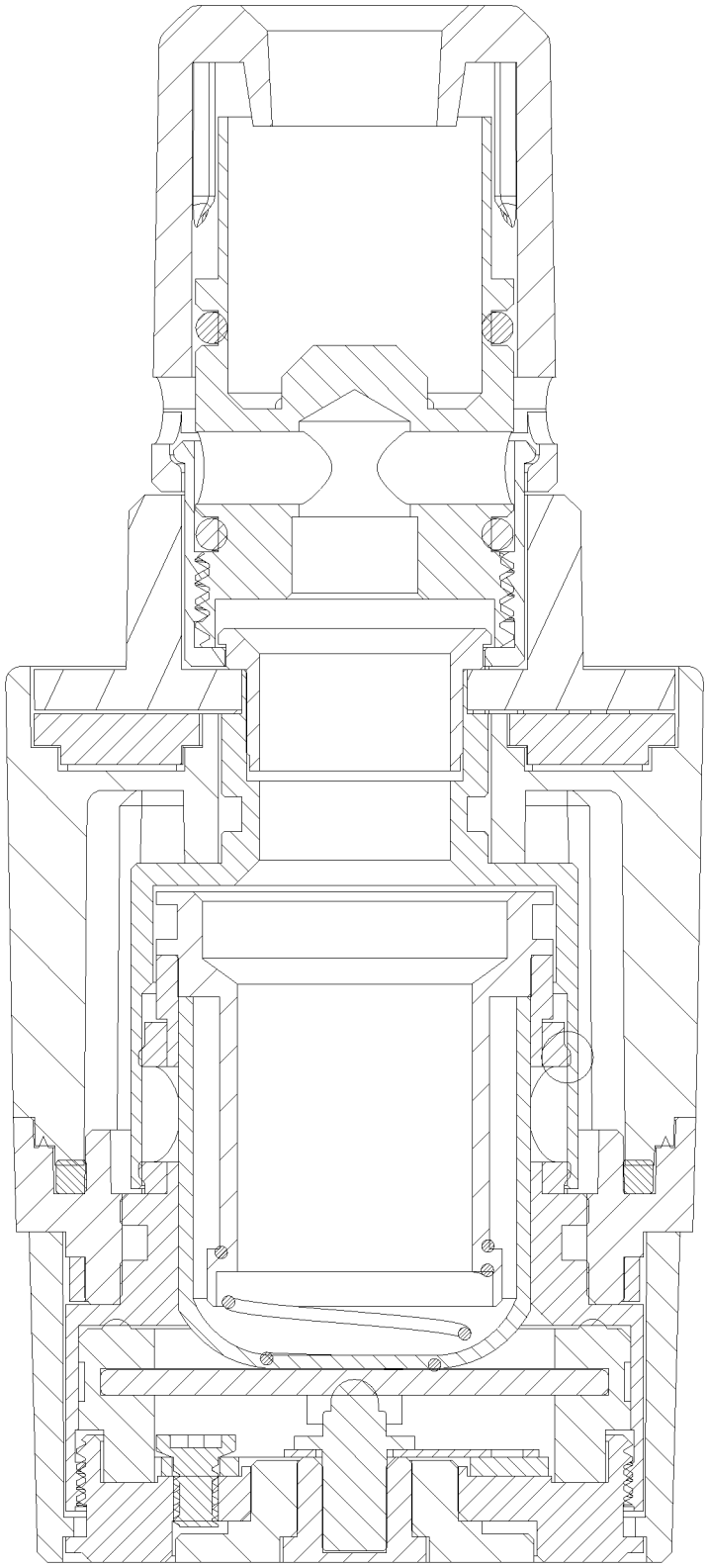
FIG. 27 is a schematic structural diagram of Embodiment 2 of the atomizer when the e-liquid injection hole is opened and the e-liquid inlet is closed.

As shown in FIG. 14 to FIG. 27, an electronic cigarette atomization core comprises an atomization member 3, an outer sleeve 24, a connection sleeve 22, and atomization cotton 14, a lower segment of the connection sleeve 22 is sleeved outside an upper segment of the outer sleeve 24, the outer sleeve 24 is sleeved outside the atomization cotton 14, and the outer sleeve 24 is provided with a first e-liquid passage hole 2401 capable of communicating an inner cavity of an electronic cigarette e-liquid bin 12 with the atomization cotton 14; the connection sleeve 22 is circumferentially rotatable relative to the outer sleeve 24 to close or open the first e-liquid passage hole 2401, and a buffer sealing structure for sealing the first e-liquid passage hole 2401 when the first e-liquid passage hole 2401 is closed is arranged between the connection sleeve 22 and the outer sleeve 24.

When an e-liquid passage needs to be cut off (for example, when e-liquid is injected and when an electronic cigarette is in a standing state for a long time), the connection sleeve 22 is driven to rotate circumferentially relative to the outer sleeve 24 to close or open the first e-liquid passage hole 2401. Because the buffer sealing structure is arranged between the connection sleeve 22 and the outer sleeve 24, the requirement for the matching dimensional precision of the connection sleeve 22 and the outer sleeve 24 is low, the assembly is convenient, the production time is short, the production cost is low, the sealing effect is good, and the risks of e-liquid leakage and e-liquid suction are avoided.

The connection sleeve 22 is provided with an e-liquid inlet 2201 capable of communicating the electronic cigarette e-liquid bin 12 with the first e-liquid passage hole 2401, and when the connection sleeve 22 rotates circumferentially relative to the outer sleeve 24, the e-liquid inlet 2201 and the first e-liquid passage hole 2401 are misaligned or opposite, to close or open the first e-liquid passage hole 2401.

The buffer sealing structure comprises a sealing sleeve 45 sleeved between the outer sleeve 24 and the connection sleeve 22, and the sealing sleeve 45 is made of silica gel. The sealing sleeve 45 is provided with a second e-liquid passage hole 4501 opposite to the first e-liquid passage hole 2401, and the second e-liquid passage hole 4501 communicates the first e-liquid passage hole 2401 with the atomization cotton 14.

The outer sleeve 24 is provided with a locking hole 2402 for preventing the axial rotation of the sealing sleeve 45, and the sealing sleeve 45 is provided with a boss 4502 matching the locking hole 2402.

The locking hole 2402 cooperates with the boss 4502, so that the sealing sleeve 45 is fixed reliably with the outer sleeve 24 to prevent rotation of the sealing sleeve 45 driven by the rotation of the connection sleeve 22.

The sealing sleeve 45 is provided with a raised ring 4503 which faces the connection sleeve 22 and is along the outer circumference of the second e-liquid passage hole 4501, and the raised ring 4503 can seal the e-liquid inlet 2201 more reliably. An electronic cigarette atomizer comprises a housing 8, the electronic cigarette atomization core in Embodiment 2 is arranged is arranged in the housing, and an air inlet 1, an air inlet passage 2, the atomization member 3, an air outlet passage 4, an air outlet 5, and a suction nozzle 6 are communicated in sequence. The air inlet passage 2 and the air outlet passage 4 are both arranged in the housing 8, a top of the housing 8 is provided with a top cover 9, and the e-liquid bin 12 is arranged in the housing 8; the suction nozzle 6 is sleeved outside the top cover 9 and is rotatable relative to the top cover 9, and the electronic cigarette atomizer further comprises an fastening mechanism for preventing the suction nozzle 6 from moving axially relative to the top cover 9; a movable member 10 and an internal thread bushing 37 are arranged in the top cover 9, and a lower segment of a side wall of the movable member 10 is in threaded connection with the internal thread bushing 37; the rotation of the suction nozzle 6 drives the movable member 10 to rotate relative to threads of the internal thread bushing 37 and to move axially along the top cover 9; the movable member 10 is provided with an air passage hole 1003 communicating the air inlet 1 with the air inlet passage 2, and when the movable member 10 moves axially along the top cover 9, an inner side wall of the internal thread bushing 37 is displaced to block part of or whole of the air passage hole 1003 to adjust the amount of air entering the air inlet passage 2; the top cover 9 is provided with an e-liquid injection hole 903 for injecting e-liquid into the e-liquid bin 12, and the top cover 9 is in clearance fit with the internal thread bushing 37.

Since the suction nozzle 6 is in threaded connection with the top cover 9, and the suction nozzle 6 and the top cover 9 are fastened, the suction nozzle 6 can be prevented from moving axially relative to the top cover 9. When the suction nozzle 6 is rotated, the movable member 10 moves axially under the drive of the suction nozzle 6, thereby adjusting the area of the part of air passage hole 1003 that is blocked by the internal thread bushing 37. The misaligned movement of the air passage hole 1003 on the movable member 10 relative to the air inlet 1 increases or decreases the air flow passing through the air passage hole 1003 in a unit time, so the adjustment is convenient, and the sealing performance is good. Since the holding area of the suction nozzle 6 is large, the rotation force during the rotation can be conveniently controlled, and the operation is simple and reliable. At the same time, since the top cover 9 is in clearance fit with the internal thread bushing 37, the top cover 9 does not rotate during the process of air adjustment, thereby the e-liquid injection hole 903 is not opened during the air adjustment, and e-liquid leakage of the e-liquid bin 12 is avoided or suction of the e-liquid due to fast e-liquid supply is avoided. Even if the suction nozzle 6 is rotated to an extreme position during the air adjustment, the top cover 9 will not be driven to rotate, and the e-liquid injection hole 903 will not be opened by mistake during the air adjustment.

The top cover 9 is riveted to the connection sleeve 22 by a pressure ring 44, and the top cover 9 drives the connection sleeve 22 to rotate circumferentially through the pressure ring 44; when the e-liquid injection hole 903 is opened, the e-liquid inlet 2201 is misaligned with the first e-liquid passage hole 2401; and when the e-liquid injection hole 903 is closed, the e-liquid inlet 2201 is aligned with the first e-liquid passage hole 2401.

Since the top cover 9 is riveted to the connection sleeve 22 by a pressure ring 44, the top cover 9 and the connection sleeve 22 are integrated, so that the rotation of the top cover 9 can drive the connection sleeve 22 to rotate at the same time, and when the top cover 9 rotates till the e-liquid injection hole 903 is opened, the e-liquid inlet 2201 can be closed to avoid sucking e-liquid after injection.

A first sealing ring 16 is arranged between the movable member 10 and the top cover 9. The air inlet 1 is formed on a side wall of the suction nozzle 6.

An air inlet pipe 15 is further arranged in the housing 8, and an inner cavity of the air inlet pipe 15 forms the air inlet passage 2; an air inlet end of the air inlet pipe 15 is connected to the movable member 10, and an air outlet end of the air inlet pipe 15 is opposite to the atomization member 3. In this embodiment, the atomization member 3 comprises an ultrasonic atomization sheet 13. The air outlet end of the air inlet pipe 15 is opposite to the atomization cotton 14 on the atomization surface of the ultrasonic atomization sheet 13. The ultrasonic atomization sheet 13 is a piezoelectric ceramic sheet 1.

Since the air inlet end of the air inlet pipe 15 is connected to the movable member 10, the movable member 10 drives the air inlet pipe 15 to move during movement, so that the relative positions of the air outlet end of the air inlet pipe 15 and the ultrasonic atomization sheet 13 are changed. When the air inlet volume is adjusted small, the distance between the air outlet end of the air inlet pipe 15 and the ultrasonic atomization sheet 13 is relatively short, so the impact of air flow is large, the smoke emitting effect is good, the concentration of smoke is not reduced while the air is adjusted, and the use is not affected.

The top cover 9 is provided with a first limiting step 904, the internal thread bushing 37 is placed on the first limiting step 904, and the pressure ring 44 is provided with a first locking step 4401 for compressing and limiting the first limiting step 904, and a second locking step 4402 for compressing and limiting a second limiting step 3701 on the internal thread bushing 37.

The internal thread bushing 37 is axially fixed by the first locking step 4401 on the pressure ring 44, and the internal thread bushing 37 can only rotate circumferentially relative to the top cover 9. When the top cover 9 is rotated to inject e-liquid, the internal thread bushing 37 does not rotate, so the air inlet amount is not affected. The e-liquid injection and air adjustment operations are independent of each other and do not affect each other.

An outer side wall of the connection sleeve 22 is provided with a limiting outer plane 2202 for limiting the circumferential rotation of the top cover 9 relative to the connection sleeve 22, and an inner side wall of the top cover 9 is provided with a limiting inner plane 905 matching the limiting outer plane 2202. The outer side wall of the connection sleeve 22 is cut with two limiting outer planes 2202 cooperating with the two limiting inner planes 905 on the top cover 9 one to one, which can further limit the rotation of the top cover 9 relative to the connection sleeve 22, to ensure that the e-liquid inlet 2201 is closed when e-liquid is injected.

A bottom of the internal thread bushing 37 is provided with two locking recesses 3702 for limiting the circumferential rotation of the internal thread bushing 37, and the e-liquid bin 12 is provided with a locking column 1201 parallel to the axis of the electronic cigarette and matching the locking recess 3702.

The locking column 1201 cooperates with the locking recess 3702 to limit the circumferential rotation of the internal thread bushing 37, so that the internal thread bushing 37 cannot be rotated when the suction nozzle 6 is rotated to adjust the air, and the e-liquid injection operation and the air adjustment operation are absolutely separated without affecting each other.

At least two raised ribs 604 parallel to the axis of the suction nozzle 6 are uniformly arranged on the circumference of the inner side wall of the suction nozzle 6, and the outer side wall of the movable member 10 has positioning planes 1006 corresponding to the raised ribs 604 one to one.

The raised ribs 604 cooperate with the positioning planes 1006 to achieve a rotation linkage effect.

The inside of a vent 603 at the top of the suction nozzle 6 has a ring portion 606 extending toward the inside of the suction nozzle 6 to prevent the condensed e-liquid from being sucked out.

The movable member 10 has a cylindrical portion 1005 opposite to the vent 603. The cylindrical portion 1005 can play a role of drainage, which can effectively help the condensed e-liquid at the suction nozzle 6 to flow back, thereby alleviating the condensation of the e-liquid at the suction nozzle 6.

The top of the cylindrical portion 1005 is a tip with an oblique angle, so that the drainage effect is better.

The housing 8 comprises a bottom cover 17, a lower cover 18, and an upper cover 19 connected sequentially from bottom to top. A second sealing ring 20 is arranged between the lower cover 18 and the upper cover 19. A compression ring 38 is arranged between the lower cover 18 and the bottom cover 17. A third sealing ring 33 is arranged between the movable member 10 and the internal thread bushing 37. The air inlet passage 2 and the air outlet passage 4 have good sealing effect, and do not leak air.

The top cover 9 is connected to a top of the upper cover 19. The e-liquid bin 12 is arranged in the top cover 9. A sealing gasket 21 is arranged between the top of the e-liquid bin 12 and the top cover 9. The sealing gasket 21 is provided with a through hole 2101 capable of communicating the e-liquid injection hole 903 with the e-liquid bin 12. When no e-liquid is injected, the e-liquid injection hole 903 is misaligned with the through hole 2101, and the e-liquid injection hole 903 is closed to prevent e-liquid leakage from the e-liquid bin 12. When e-liquid is injected, the top cover 9 is rotated to communicate the e-liquid injection hole 903 with the through hole 2101, and the e-liquid injection hole 903 is opened to inject the e-liquid into the e-liquid bin 12.

An inner sleeve 23 is further arranged in the connection sleeve 22, and the outer sleeve 24 is sleeved outside the inner sleeve 23. A fourth sealing ring 34 is arranged between the inner sleeve 23 and the connection sleeve 22. A fifth sealing ring 35 is arranged between the outer sleeve 24 and the lower cover 18. A sixth sealing ring 36 is arranged between the connection sleeve 22 and the upper cover 19. The atomization cotton 14 is cup-shaped, a side wall of the cup-shaped atomization cotton 14 is sandwiched between the inner sleeve 23 and the outer sleeve 24, and an outer bottom surface of the cup-shaped atomization cotton 14 is in contact with the ultrasonic atomization sheet 13. A lower segment of the air inlet pipe 15 extends into the inner sleeve 23 and an outlet of the lower segment of the air inlet pipe 15 is opposite to the inner bottom surface of the atomization cotton 14. A cotton pressing spring 25 is further arranged in the cup-shaped atomization cotton 14, one end of the cotton pressing spring 25 abuts against the inner sleeve 23, and the other end of the cotton pressing spring 25 abuts against the inner bottom surface of the cup-shaped atomization cotton 14.

The ultrasonic atomization sheet 13 is fixed in the bottom cover 17 through an atomization seat 26.

A bottom of the bottom cover 17 is provided with a threaded seat 27 for sealing.

A lower electrode 28 is arranged in the threaded seat 27, and the lower electrode 28 abuts against the ultrasonic atomization sheet 13 through a spring electrode 29. The spring electrode 29 is electrically connected to a PCB 41 through a conductive sheet 40. The PCB 41 is connected to the threaded seat 27 by a screw 39. The lower electrode 28 is connected to the threaded seat 27 in an insulating manner by an insulating ring 30.

The embodiments of the present invention are described above with reference to the drawings, but the present invention is not limited to the above specific embodiments. The specific embodiments are only illustrative but not limiting. Many forms can also be made by those of ordinary skilled in the art under the enlightenment of the present invention without departing from the purpose of the present invention and the protection scope of the claims, and all these forms fall within the protection scope of the present invention.

The invention claimed is:

1. An electronic cigarette atomization core, comprising:

an atomization member (3), an outer sleeve (24), a connection sleeve (22), and atomization cotton (14), wherein:

a lower segment of the connection sleeve (22) is sleeved outside an upper segment of the outer sleeve (24), the outer sleeve (24) is sleeved outside the atomization cotton (14), and the outer sleeve (24) is provided with a first e-liquid passage hole (2401) capable of communicating an inner cavity of an electronic cigarette e-liquid bin (12) with the atomization cotton (14);

the connection sleeve (22) is axially movable or circumferentially rotatable relative to the outer sleeve (24) to close or open the first e-liquid passage hole (2401), and a buffer sealing structure, for sealing the first e-liquid passage hole (2401) when the first e-liquid passage hole (2401) is closed, is arranged between the connection sleeve (22) and the outer sleeve (24).

2. The electronic cigarette atomization core according to claim 1, wherein:

the buffer sealing structure comprises a sealing gasket (46) fixedly sleeved outside a lower segment of the outer sleeve (24), and a top surface of the sealing gasket (46) is below a lowest point of the first e-liquid passage hole (2401) or tangent to the lowest point of the first e-liquid passage hole (2401);

when the connection sleeve (22) moves in an axial direction of the electronic cigarette until a bottom end of the connection sleeve (22) abuts against the sealing gasket (46), the first e-liquid passage hole (2401) is closed; and when the connection sleeve (22) moves in the axial direction of the electronic cigarette until the bottom end of the connection sleeve (22) separates from the sealing gasket (46), the first e-liquid passage hole (2401) is opened.

3. The electronic cigarette atomization core according to claim 2, wherein a bottom surface of the sealing gasket (46) is provided with a force deformation structure.

4. The electronic cigarette atomization core according to claim 3, wherein the force deformation structure comprises a blind hole (4601) arranged on the bottom surface of the sealing gasket (46).

5. The electronic cigarette atomization core according to claim 1, wherein:

the connection sleeve (22) is provided with an e-liquid inlet (2201) capable of communicating the electronic cigarette e-liquid bin (12) with the first e-liquid passage hole (2401), and when the connection sleeve (22) rotates circumferentially relative to the outer sleeve (24), the e-liquid inlet (2201) and the first e-liquid passage hole (2401) are misaligned or opposite, to close or open the first e-liquid passage hole (2401).

6. The electronic cigarette atomization core according to claim 5, wherein:

the buffer sealing structure comprises a sealing sleeve (45) sleeved between the outer sleeve (24) and the connection sleeve (22), the sealing sleeve (45) is provided with a second e-liquid passage hole (4501) opposite to the first e-liquid passage hole (2401), and the second e-liquid passage hole (4501) communicates the first e-liquid passage hole (2401) with the atomization cotton (14).

7. The electronic cigarette atomization core according to claim 6, wherein:

the outer sleeve (24) is provided with a locking hole (2402) for preventing axial rotation of the sealing sleeve (45), and the sealing sleeve (45) is provided with a boss (4502) matching the locking hole (2402).

8. The electronic cigarette atomization core according to claim 7, wherein the sealing sleeve (45) is provided with a raised ring (4503) which faces the connection sleeve (22) and is along an outer circumference of the second e-liquid passage hole (4501).

9. An electronic cigarette atomizer, comprising:

an electronic cigarette atomization core, wherein the electronic cigarette atomization core comprises:

an atomization member (3), an outer sleeve (24), a connection sleeve (22), and atomization cotton (14), wherein:

a lower segment of the connection sleeve (22) is sleeved outside an upper segment of the outer sleeve (24), the outer sleeve (24) is sleeved outside the atomization cotton (14), and the outer sleeve (24) is provided with a first e-liquid passage hole (2401) capable of communicating an inner cavity of an electronic cigarette e-liquid bin (12) with the atomization cotton (14); and the connection sleeve (22) is axially movable or circumferentially rotatable relative to the outer sleeve (24) to close or open the first e-liquid passage hole (2401), and a buffer sealing structure, for sealing the first e-liquid passage hole (2401) when the first e-liquid passage hole (2401) is closed, is arranged between the connection sleeve (22) and the outer sleeve (24).

10. The electronic cigarette atomizer according to claim 9, further comprising a housing (8), wherein:

the electronic cigarette atomization core is arranged in the housing (8);

a top of the housing (8) is provided with a top cover (9), and the e-liquid bin (12) is arranged in the housing (8); and rotation of the top cover (9) drives the connection sleeve (22) to move axially or rotate circumferentially along the electronic cigarette.

11. The electronic cigarette atomizer according to claim 10, further comprising a pressure ring (44) connected to the top cover (9) by riveting; wherein the rotation of the top cover (9) drives the connection sleeve (22) through the pressure ring (44) to move axially or rotate circumferentially along the electronic cigarette.

12. The electronic cigarette atomizer according to claim 11, wherein:

the housing (8) is provided with an air inlet passage (2) and an air outlet passage (4) therein, and a suction nozzle (6) is sleeved outside the top cover (9) and is rotatable relative to the top cover (9);

an air inlet (1), the air inlet passage (2), the atomization member (3), the air outlet passage (4), an air outlet (5), and the suction nozzle (6) are communicated in sequence;

a movable member (10) and an internal thread bushing (37) are arranged in the top cover (9), and a lower segment of a side wall of the movable member (10) is in threaded connection with the internal thread bushing (37);

the rotation of the suction nozzle (6) drives the movable member (10) to rotate relative to threads of the internal thread bushing (37) and to move axially along the top cover (9); and the movable member (10) is provided with an air passage hole (1003) communicating the air inlet (1) with the air inlet passage (2), and when the movable member (10) moves axially along the top cover (9), an inner side wall of the internal thread bushing (37) is displaced to block part of or whole of the air passage hole (1003) to adjust an amount of air entering the air inlet passage (2).

13. The electronic cigarette atomizer according to claim 12, wherein the top cover (9) is provided with an e-liquid injection hole (903) for injecting e-liquid into the e-liquid bin (12), and the top cover (9) is in clearance fit with the internal thread bushing (37).

14. The electronic cigarette atomizer according to claim 12, wherein:

an air inlet pipe (15) is further arranged in the housing (8), and an inner cavity of the air inlet pipe (15) forms the air inlet passage (2); and an air inlet end of the air inlet pipe (15) is connected to the movable member (10), and an air outlet end of the air inlet pipe (15) is opposite to the atomization member (3).

15. The electronic cigarette atomizer according to claim 12, wherein an inside of a vent (603) at a top of the suction nozzle (6) has a ring portion (606) extending toward an inside of the suction nozzle (6).

16. The electronic cigarette atomizer according to claim 12, further comprising a fastening mechanism for preventing the suction nozzle (6) from moving axially relative to the top cover (9).

17. The electronic cigarette atomizer according to claim 12, wherein the movable member (10) has a cylindrical portion (1005) opposite to the vent (603).

18. The electronic cigarette atomizer according to claim 17, wherein a top of the cylindrical portion (1005) is a tip with an oblique angle.

19. The electronic cigarette atomizer according to claim 12, wherein:

the pressure ring (44) is sleeved outside an upper segment of the connection sleeve (22), an inner side wall of the pressure ring (44) is provided with a limiting plane (4403) for limiting the circumferential rotation of the connection sleeve (22), and an outer side wall of the connection sleeve (22) is provided with a limiting outer plane (2202) matching the limiting plane (4403); and the internal thread bushing (37) is placed on the pressure ring (44).

20. The electronic cigarette atomizer according to claim 19, wherein:

a bottom of the internal thread bushing (37) is provided with at least two locking recesses (3702) for limiting a circumferential rotation of the internal thread bushing (37), the e-liquid bin (12) is provided with a locking column (1201) parallel to the axis of the electronic cigarette and matching the locking recess (3702), a first limiting slot (4404) is formed on an outer circumference of the pressure ring (44), and the locking column (1201) passes through the first limiting slot (4404) and is locked into the locking recess (3702).

* * * * *